US011220857B2

(12) United States Patent
Swartz et al.

(10) Patent No.: US 11,220,857 B2
(45) Date of Patent: Jan. 11, 2022

(54) FIRE-RESISTANT SLIDING DOOR SYSTEM

(71) Applicant: AD Solutions, Inc., Carmel, IN (US)

(72) Inventors: Dustin Dale Swartz, Bothell, WA (US); Jeffrey Thomas Morovich, Everett, WA (US); Ryan J. Martin, Stanwood, WA (US)

(73) Assignee: AD Solutions, Inc., Carmel, IN (US)

( * ) Notice: Subject to any disclaimer, the term of this patent is extended or adjusted under 35 U.S.C. 154(b) by 0 days.

(21) Appl. No.: 16/599,062

(22) Filed: Oct. 10, 2019

(65) Prior Publication Data

US 2020/0115953 A1 Apr. 16, 2020

Related U.S. Application Data

(60) Provisional application No. 62/745,205, filed on Oct. 12, 2018.

(51) Int. Cl.
*E06B 5/16* (2006.01)

(52) U.S. Cl.
CPC ..... *E06B 5/164* (2013.01); *E05Y 2201/688* (2013.01); *E05Y 2800/416* (2013.01); *E05Y 2900/134* (2013.01)

(58) Field of Classification Search
CPC ..... E06B 5/164; E06B 5/16; E05Y 2201/688; E05Y 2800/416; E05Y 2900/134; E05D 15/06
See application file for complete search history.

(56) References Cited

U.S. PATENT DOCUMENTS 4,404,770 A * 9/1983 Markus ..... E05D 15/1021 49/235
4,619,075 A * 10/1986 Wiles ..... E05D 15/1021 49/235
4,651,469 A * 3/1987 Ngian ..... E05D 15/1021 16/87 R
5,461,829 A * 10/1995 Lehto ..... E05D 15/1021 16/87 R
7,497,050 B2 3/2009 Romero et al.
7,568,311 B2 * 8/2009 Shivak ..... E04B 2/7455 49/409
7,610,718 B2 * 11/2009 Kopish ..... E05F 5/003 49/211
2002/0017060 A1 2/2002 Kern et al.
2007/0227074 A1 10/2007 Frank
2009/0133344 A1 5/2009 Harkins et al.
(Continued)

OTHER PUBLICATIONS

Chase Doors, "Saino Sliding Fire Doors Model 3000 & 4000," captured on Jun. 19, 2017 from http://chasedoors.com/productdisplay.asp?productid=35, downloaded from https://web.archive.org/web/20170619071815/http://chasedoors.com/productdisplay.asp?productid=35 on Jan. 31, 2020, 3 pages.
(Continued)

*Primary Examiner* — Beth A Stephan
(74) *Attorney, Agent, or Firm* — Seed IP Law Group LLP

(57) ABSTRACT

A sliding door system may satisfy the requirements of, and be fire-rated in accordance with, UL10B ("Standard for Fire Tests of Door Assemblies"), and/or satisfy the requirements of, and be pressure-rated in accordance with, UL10C ("Standard for Positive Pressure Fire Tests of Door Assemblies").

21 Claims, 28 Drawing Sheets

(56) References Cited

U.S. PATENT DOCUMENTS

| | | | | |
|---|---|---|---|---|
| 2010/0242370 | A1 | 9/2010 | Trulaske, Sr. | |
| 2017/0191303 | A1 | 7/2017 | Purdom et al. | |
| 2019/0010307 | A1* | 1/2019 | King, III | C08K 5/1535 |
| 2019/0264484 | A1* | 8/2019 | Tuminella | E05D 15/0686 |

OTHER PUBLICATIONS

Manusa, "Fire-resistant door," captured on Jun. 15, 2018 from http://www.manusa.com/Doors/Fire-Rated-Doors.html, downloaded from https://web.archive.org/web/20180615165539/http://www.manusa.com/Doors/Fire-Rated-Doors.html on Jan. 30, 2020, 2 pages.

* cited by examiner

FIRE-RESISTANT SLIDING DOOR SYSTEM

BACKGROUND

Technical Field

The present disclosure generally relates to fire-resistant sliding door systems and components thereof.

Description of the Related Art

Sliding and hinged doors are widely commercially available. Doors can be built and tested to provide fire-ratings and/or pressure ratings. UL10B ("Standard for Fire Tests of Door Assemblies") is a standard by which a fire-rating of a door assembly can be assessed. UL10C ("Standard for Positive Pressure Fire Tests of Door Assemblies") is a standard by which a fire endurance and positive pressure rating of a door assembly can be assessed.

BRIEF SUMMARY

Historically, when a door is required to meet UL Fire Rating standards with hose stream test, the only available option was a side-hinged swinging door. The technology described herein advantageously allows the use of a sliding door which is often desired for space savings and ease of operation. The integrity of the assembly is such that it not only passes fire endurance tests but also high-pressure hose stream tests as required by UL10B and UL10C for compliance in the USA and other regions as per the IBC (International Building Code). Thus, fire-resistant sliding door systems capable of passing UL10B and/or UL10C fire endurance and hose stream qualifications are described herein.

In some implementations, a sliding door system includes an aluminum door frame, a mineral core door leaf, steel or stainless steel components that interlock the door frame with the door leaf, manually operated or motorized rolling suspension hardware, and a self-closing spring with a self-latching mortise lock. Notably, such a sliding door assembly has been found to successfully pass the 45 minute fire endurance test as per UL10B and the hose stream test as per UL10C. Thus, the door systems of the present disclosure are able to be utilized anywhere a 45 minute fire rated door is required as per most U.S.-derived building codes.

The sliding door assembly may include a single leaf, manually operated man door that is equipped with a self-closing recoil spring door closer and self-latching mortise lock with lever handles. In operation, a user may approach the door from either side and grasp the lever handle, rotate the lever to cause the door to unlatch, and pull the handle horizontally to cause the door panel or leaf to slide open, thereby allowing the user to pass through the open doorway. Upon passing through the entrance, the door may automatically close and latch.

In at least some implementations, the sliding door assembly may include a single leaf, electrically operated automatic man door that is equipped with electric motor/self-latching mortise lock and electric strike. In such implementations, a user may approach the door from either side and activate the electric motor via various optional methods (e.g., automatic detection sensor (IR, laser, etc.), pushbutton switch, or card reader switch, etc.). Upon activation, the electric strike would first be triggered to release the mechanical latch, then the automatic operator motor would be turned on to open the door. After the user walks through the door, the door may close and latch automatically. Optionally, the door can be outfitted with a lever handle to allow for a mechanical override by the user. Rotating the lever may cause the door to unlatch, and pulling the handle horizontally may cause the door panel to slide open to allow the user to pass through the open doorway.

Various components of the sliding door assemblies described herein, including the sliding door leaves, may be made of various materials, including wood, hollow metal, tubular steel frame with glass lites, and/or an aluminum hybrid. In some implementations, the sliding door assemblies described herein can include a stainless steel sub frame/interlock system. In at least some implementations, one set of components may be mounted to the door leaf, the other set of components may be mounted to the face of the aluminum frame. In at least some implementations, in the sliding door assemblies described herein, screws may go all the way through the aluminum frame and into the wall studs so that, in a fire, the load of the door leaf is transferred into the wall studs.

A system may be summarized as comprising: a first rail coupleable to an opening of a wall at a first location above the opening, the opening extending between a front surface of the wall and a rear surface of the wall; a second rail coupleable to the wall at a second location above the opening; a door panel including: a plurality of wheels engaged with the first rail; and a top end door seal configured to interlock with the second rail to create a seal between the door panel and the wall upon failure of the engagement of the wheels with the first rail.

The system may further comprise a door frame including a header mounted to the wall at a top end of the opening, a leading jamb mounted to the wall at a leading end of the opening, and a trailing jamb mounted to the wall at a trailing end of the opening, wherein the second rail is coupled to the header. The wall may include a plurality of studs and the second rail may be coupled to the header by a mechanical fastener that extends through the second rail, through the header, and into one of the studs. The mechanical fastener may extend through the second rail, through the header, through the first rail, and into the one of the studs. The first rail may be coupled to the wall by a second mechanical fastener that extends through the first rail and into one of the studs, and that does not extend through the second rail or through the header. The system may further comprise a strip of intumescent tape located between the second rail and the top end door seal. Components of the door frame may be made of aluminum, the first rail may be made of stainless steel, and the second rail may be made of stainless steel.

The second rail may have a first flange that lies against the header, a web that extends forward from a bottom end of the first flange, and a second flange that extends upward from a front end of the web. The door panel may include a door leaf having an upper surface and the top end door seal may include a first flange that lies against the upper surface of the door leaf and a second flange that extends downward from a rear end of the first flange. The top end door seal may create a gap between the second flange of the top end door seal and a rear surface of the door leaf. The second flange of the top end door seal may be positioned at least partially between the first flange of the second rail and the second flange of the second rail and the second flange of the second rail may be positioned at least partially between the second flange of the top end door seal and the door leaf. The header may include a body of a material having a high thermal capacity.

The system may further comprise a leading edge column coupled to the leading jamb. The wall may include a plurality of studs and the leading edge column may be coupled to the leading jamb by a mechanical fastener that extends through the leading edge column, through the leading jamb, and into one of the studs. The system may further comprise a strip of intumescent tape located between the door panel and the leading edge column. The leading jamb may include a body of a material having a high thermal capacity. The leading edge column may include a body of a material having a high thermal capacity. The system may further comprise a trailing edge column coupled to the trailing jamb. The wall may include a plurality of studs and the trailing edge column may be coupled to the trailing jamb by a mechanical fastener that extends through the trailing edge column, through the trailing jamb, and into one of the studs. The system may further comprise a strip of intumescent tape located between a component of the door panel and the trailing edge column. The trailing jamb may include a body of a material having a high thermal capacity.

DETAILED DESCRIPTION

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures associated with the technology have not been shown or described in detail to avoid unnecessarily obscuring descriptions of the implementations.

Unless the context requires otherwise, throughout the specification and claims that follow, the word "comprising" is synonymous with "including," and is inclusive or open-ended (i.e., does not exclude additional, unrecited elements or method acts).

Reference throughout this specification to "one implementation" or "an implementation" means that a particular feature, structure or characteristic described in connection with the implementation is included in at least one implementation. Thus, the appearances of the phrases "in one implementation" or "in an implementation" in various places throughout this specification are not necessarily all referring to the same implementation. Furthermore, the particular features, structures, or characteristics may be combined in any suitable manner in one or more implementations.

As used in this specification and the appended claims, the singular forms "a," "an," and "the" include plural referents unless the context clearly dictates otherwise. It should also be noted that the term "or" is generally employed in its broadest sense, that is, as meaning "and/or" unless the context clearly dictates otherwise.

Figure 1:
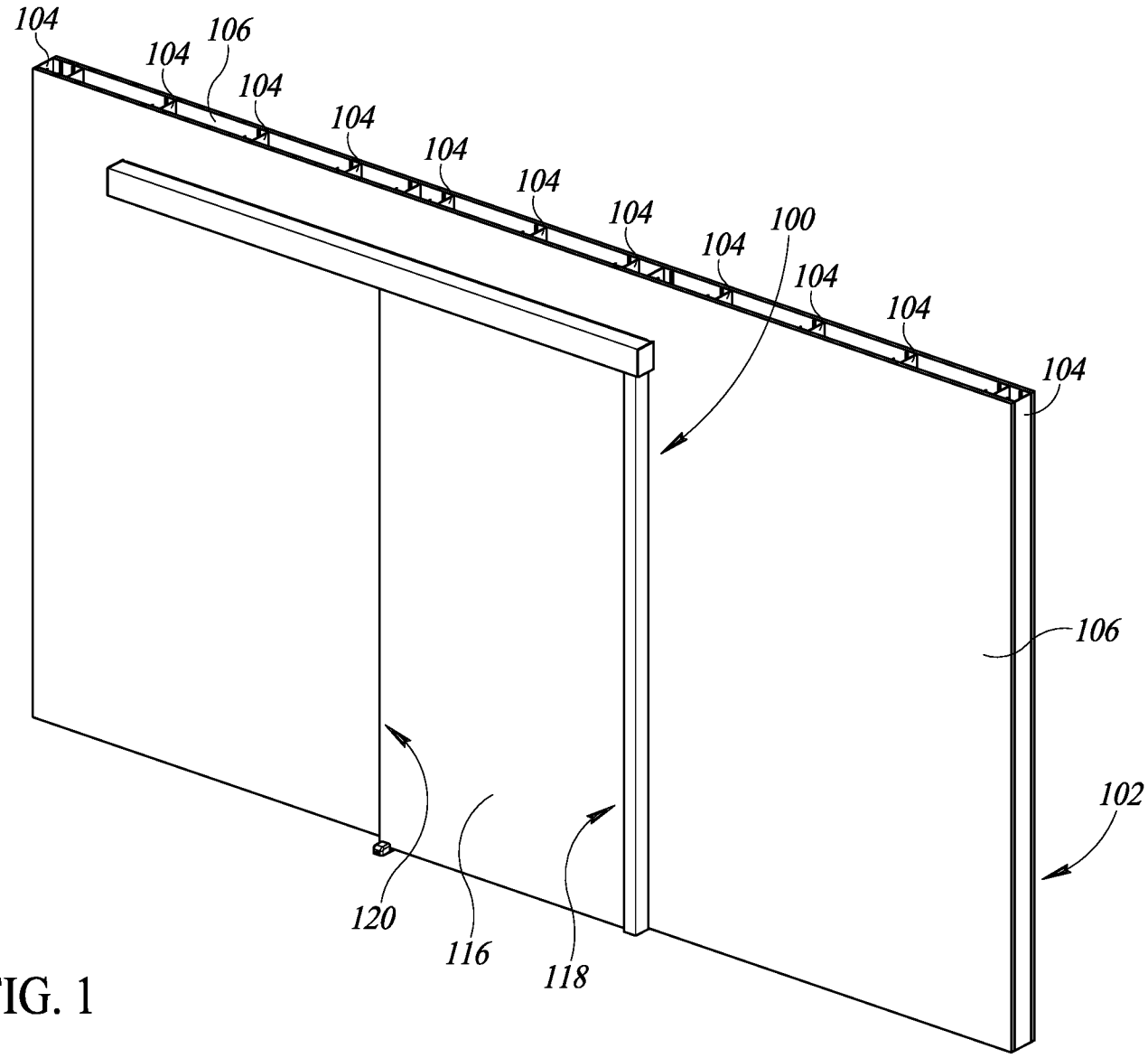
FIG. 1 illustrates a fire-resistant sliding door system installed on a door frame at an opening in a wall, in accordance with one or more implementations of the technologies described herein.

FIG. 1 illustrates a front, top, right-side perspective view of a fire-resistant sliding door system 100 installed on a door frame at an opening in a wall 102. The wall 102 may be any suitable wall. The opening in the wall 102 may be suitable for a human to comfortably walk through and may have dimensions meeting one or more building code requirements for doors. In some implementations, the wall 102 includes a set of columns or studs 104 arranged in a line establishing the path of the wall 102, and cladding, such as sheetrock or drywall 106, coupled to the studs 104 to form the outer boundaries and surfaces of the wall 102. In some implementations, an additional stud or studs can span horizontally across the top of the opening in the wall 102 between the vertical studs illustrated in FIG. 1, to provide additional strength and rigidity.

Figure 2:
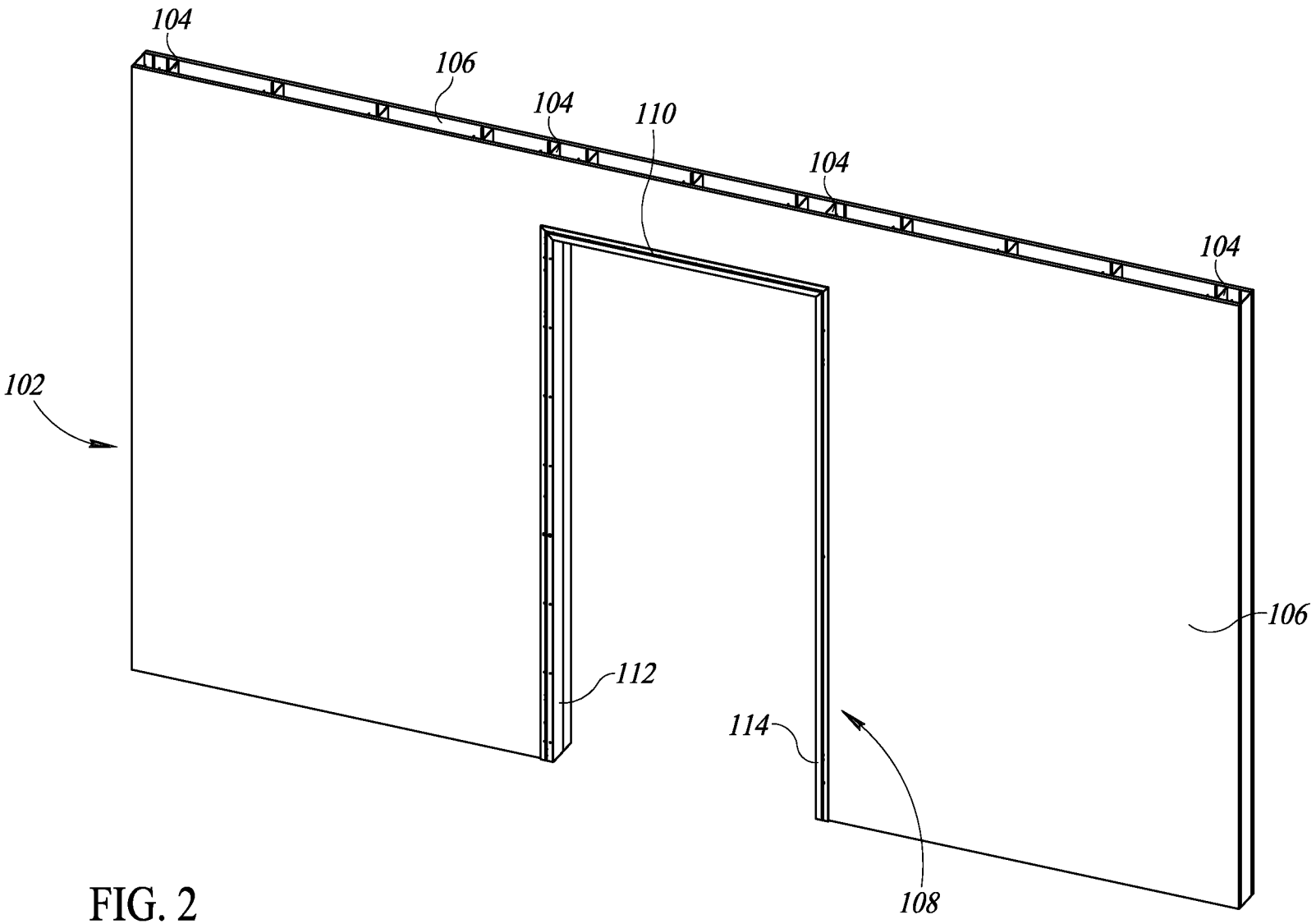
FIG. 2 illustrates the door frame at the opening in the wall of FIG. 1, in accordance with one or more implementations of the technologies described herein.

FIG. 2 illustrates the wall 102 and the door frame 108 with the sliding door system 100 removed to more clearly illustrate other features. The door frame 108 may be any suitable door frame, with example features described further below, and may include a header 110, trailing jamb 112, and leading jamb 114. As illustrated in FIG. 2, the header 110, the trailing jamb 112, and the leading jamb 114 can each include components facing into the opening in the wall 102 as well as components that wrap around the edges of the opening in the wall 102 and lie on the external surfaces of the wall 102 adjacent the opening in the wall 102.

FIG. 1 also illustrates that the sliding door system 100 includes a sliding door panel or 116. The door panel 116 is movable between a closed position (as shown in FIG. 1) wherein the door panel covers an opening in the wall 102 and an open position wherein the door panel is moved to the left to expose the door opening in the wall. In other implementations, the sliding door system 100 may be configured to open to the right ("right-opening" or "right-handed") rather than open to the left ("left-opening" or "left-handed"). The features of various components of such other implementations may be the reverse, or a mirror image of, the features described herein. The door panel 116 includes a leading edge 118 and a trailing edge 120 opposite the leading edge 118. The door panel 116 may be top-hanging from a track or rail system disposed in a top portion of the sliding door system 100 with no exposed floor track at a bottom of the door panel 116, such that there is an air gap between the bottom of the door panel 116 and a floor surface below the bottom of the door panel 116.

As used herein, terms such as "front," "forward," "back," "rearward," "behind," and other similar terminology, when used in the context of the sliding door system 100, wall 102, or door frame 108, are used with respect to a viewer located on the side of the wall 102 to which the sliding door system 100 is mounted, and along which the door panel 116 slides when in use. Thus, in some cases, "front," "forward," and other similar terms refer to a feature being located away from or far from the wall 102 in the direction of such a viewer, while words such as "back," "rearward," "behind," and other similar terms refer to a feature being located toward or near the opposite side of the sliding door system 100, the wall 102, or the door frame 108. As used herein, terms of relative elevation, such as "top," "bottom," "upper," lower," "above," "below," "up," and "down," are used in their ordinary sense, that is, with respect to a direction of a gravitational force, such that gravity pulls objects down.

As used herein, terms such as "right" and "left" refer to locations as viewed toward the front of the sliding door system 100. As noted above, the sliding door system 100 may include either a right-handed or a left-handed door panel 116. Thus, where terms such as "right" and "left" are used herein, it is understood that such terms may be reversed, inverted, or swapped if the handedness of the door panel changes. For purposes of clarity in this regard, where features are illustrated in the Figures as being to the "right" or to the "left" of other components according to this understanding, such features may be described herein as being "leading" or "trailing," respectively, to indicate that the features are located generally in the direction in which the door closes or generally in the direction in which the door opens, respectively. In some cases, such features may be described herein as being "inward," "inner," "outward," or "outer" to indicate that the features are located generally toward or away, respectively, from a center of the opening in the wall 102 or a center of the door panel 116.

Figure 3:
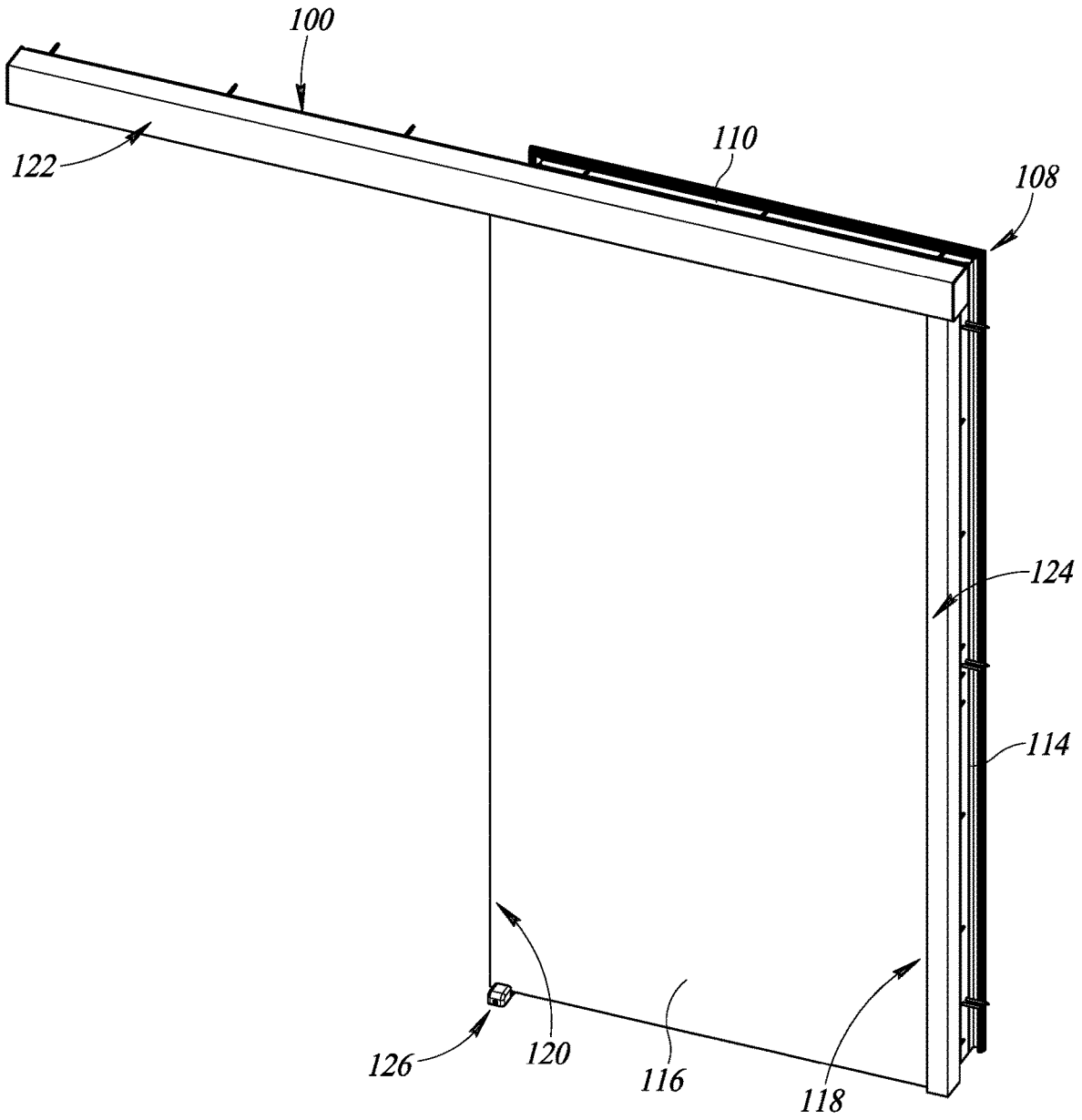
FIG. 3 illustrates the sliding door system of FIG. 1 coupled to the door frame of FIG. 1, in accordance with one or more implementations of the technologies described herein.

FIG. 3 illustrates the sliding door system 100 coupled to the door frame 108, with the features of the wall 102 removed for additional clarity. As illustrated in FIG. 3, the sliding door system 100 includes a header 122, a leading edge post or column 124, a guide wheel assembly 126, and the door panel 116. The header 122 of the sliding door system 100 is separate and distinct from (i.e., comprises different components than) the header 110 of the door frame 108, and includes components that are coupled to the header 110 of the door frame 108 and/or to the wall 102. Similarly, the leading edge column 124 of the sliding door system 100 is separate and distinct from (i.e., comprises different components than) the leading jamb 114 of the door frame 108, and includes components that are coupled to the leading jamb 114 of the door frame 108 and/or to the wall 102.

While not illustrated in FIG. 3 because it is located behind the door panel 116 in the view of FIG. 3, the sliding door system 100 also includes a trailing edge post or column (see FIGS. 6-11). The trailing edge column is separate and distinct from (i.e., comprises different components than) the trailing jamb 112 of the door frame 108, and includes components that are coupled to the trailing jamb 112 of the door frame 108 and/or to the wall 102. The guide wheel assembly 126 is coupled to the trailing edge column and can be coupled to the floor surface to maintain its position relative to the other components.

Figure 4:
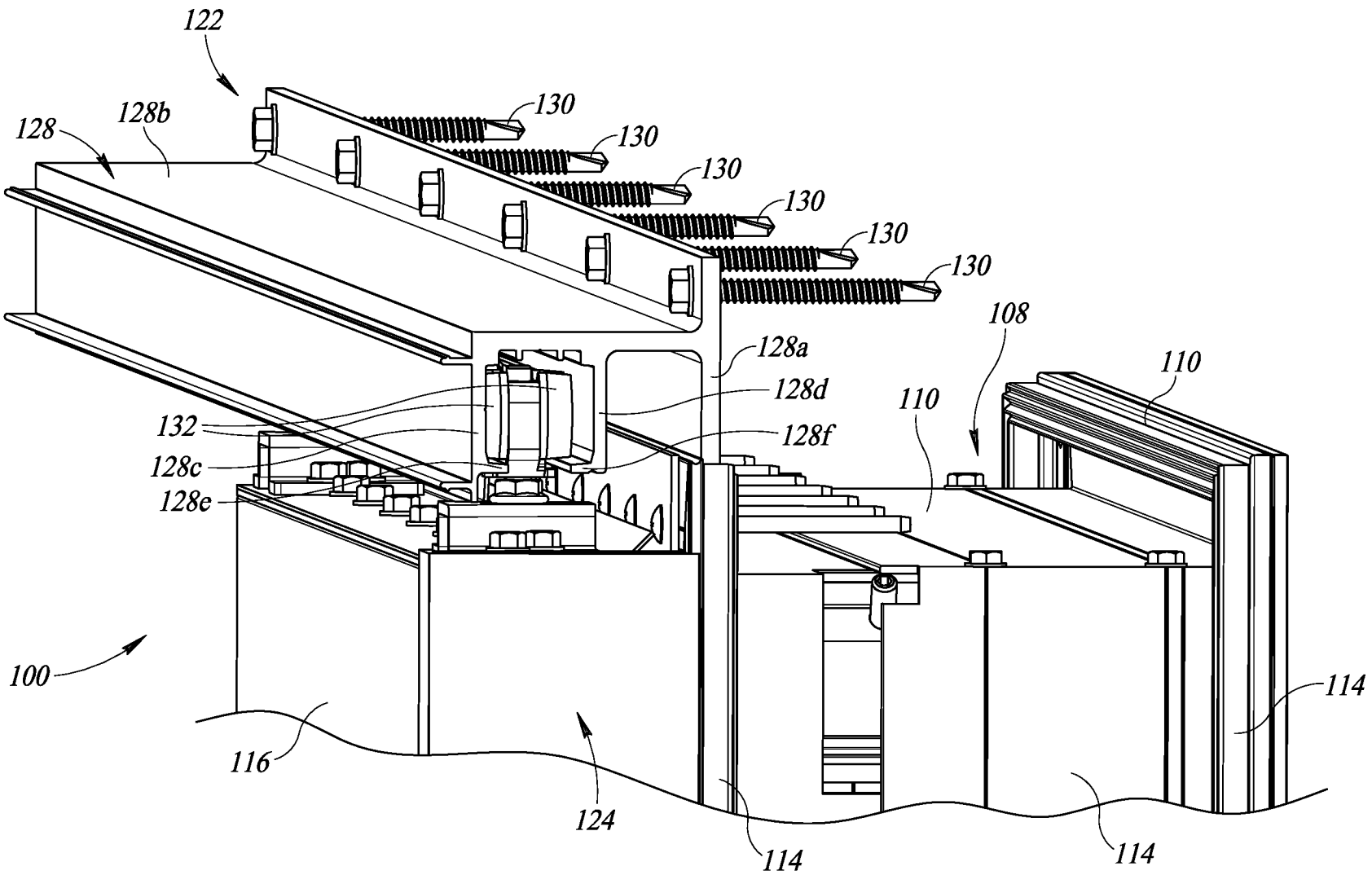
FIG. 4 illustrates the sliding door system of FIG. 1 coupled to the door frame of FIG. 1, with outer housing components removed, in accordance with one or more implementations of the technologies described herein.

FIG. 4 illustrates a relatively close-up perspective view of the components illustrated in FIG. 3, but with a cover or housing of the header 122 of the sliding door system 100 removed to more clearly illustrate other features. As illustrated in FIG. 4, the header 122 of the sliding door system 100 includes a rail 128 screwed into the wall 102, such as into a horizontal stud at the head of the opening in the wall 102, by a plurality of, such as six, mechanical fasteners such as screws or bolts 130, which may be equally spaced along the length of the rail 128. The rail 128 includes a first vertical flange 128*a* that can lie flush against the wall 102 and through which the bolts 130 extend to couple the rail 128 to the wall 102. The rail 128 also includes a first horizontal flange 128*b* that extends horizontally outward from the first vertical flange 128*a* and forward away from the wall 102. The rail 128 also includes second and third vertical flanges 128*c* and 128*d* that extend vertically downward from an underside of the horizontal flange 128*b* and parallel to one another. The rail 128 also includes a second horizontal flange 128*e* that extends from the bottom end of second vertical flange 128*c* and toward the bottom end of the third vertical flange 128*d*, and a third horizontal flange 128*f* that extends from the bottom end of third vertical flange 128*d* and toward the bottom end of the second vertical flange 128*c*.

The second and third horizontal flanges 128*e* and 128*f*, respectively, can be co-planar with one another and upper surfaces thereof can provide bearing surfaces for a set of rollers or wheels 132 to slide or roll along to move the door panel 116 back and forth along the rail 128, such as between an open and a closed position. Thus, the door panel 116 can be supported by the wheels 132 on the rail 128 and can therefore be referred to as being "hung" on the rail 128 and thereby on the wall 102. While one specific implementation of the rail 128 and bolts 130 is illustrated herein, various alternative systems and components can be used to mount and/or hang the door panel 116 to the wall 102.

Figure 5:
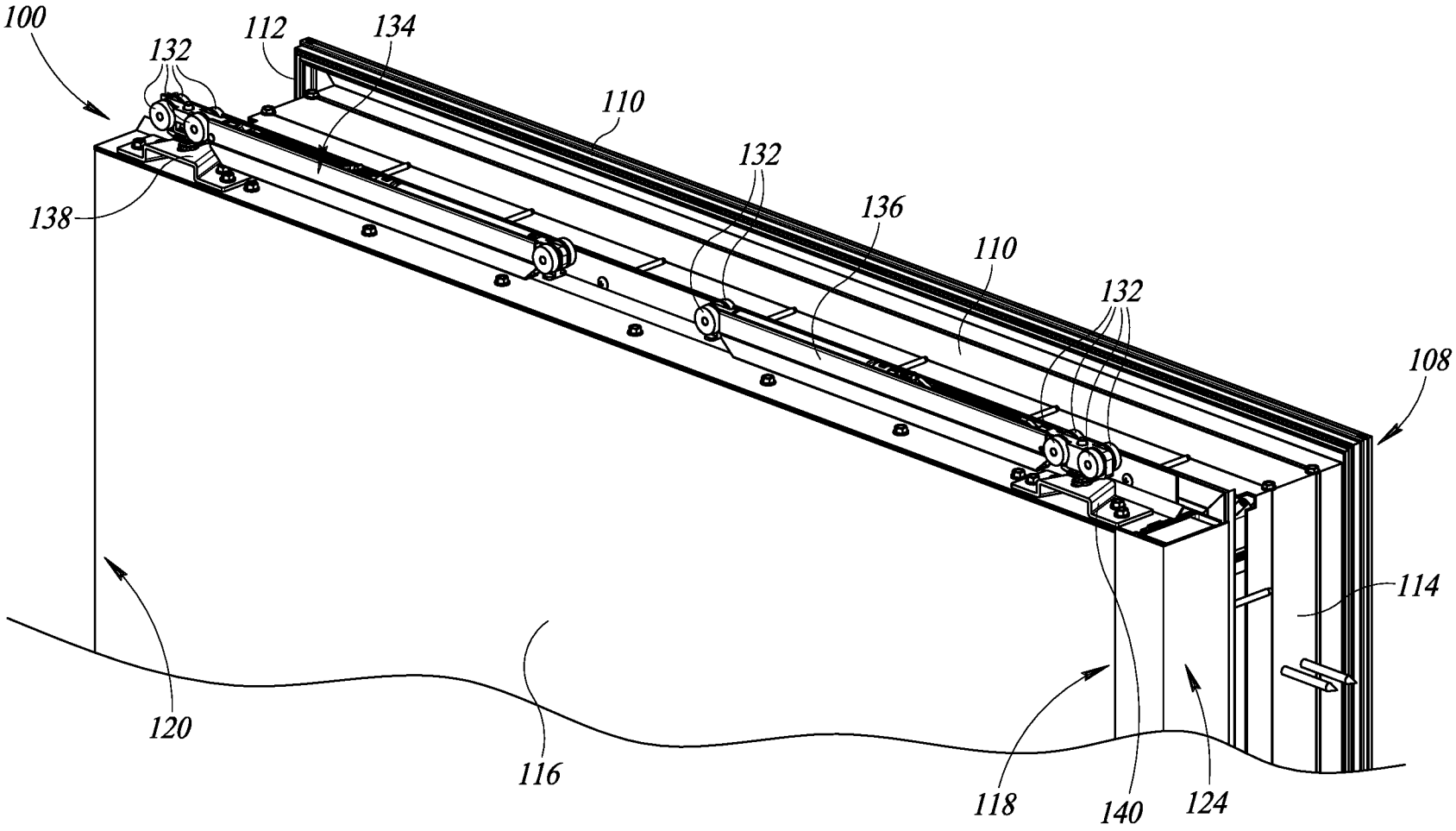
FIG. 5 illustrates the sliding door system of FIG. 1 coupled to the door frame of FIG. 1, with outer housing and hanging railing components removed, in accordance with one or more implementations of the technologies described herein.

FIG. 5 illustrates another perspective view of the components illustrated in FIG. 4, but with the rail 128 and bolts 130 removed to more clearly illustrate other features. As illustrated in FIG. 5, the header 122 of the sliding door system 100 includes a first wheel assembly 134 coupled to the door panel 116 by a first bracket 138 mounted to a top edge of the door panel 116 near the trailing edge 120 thereof and a second wheel assembly 136 coupled to the door panel 116 by a second bracket 140 mounted to a top edge of the door panel 116 near the leading edge 118 thereof. As illustrated in FIG. 5, the first wheel assembly 134 extends from a location just outside its connection to the first bracket 138 along the top edge of the door panel 116 and toward a center portion of the door panel 116. Similarly, the second wheel assembly 136 extends from a location just outside its connection to the second bracket 140 along the top edge of the door panel 116 and toward the center portion of the door panel 116.

The first wheel assembly 134 includes a first pair of wheels 132 located just outside of its connection to the first bracket 138, a second pair of wheels 132 located just inside its connection to the first bracket 138, and a third pair of wheels 132 located near the center of the door panel 116 along its top edge. Similarly, the second wheel assembly 136 includes a first pair of wheels 132 located just outside of its connection to the second bracket 140, a second pair of wheels 132 located just inside its connection to the second bracket 140, and a third pair of wheels 132 located near the center of the door panel 116 along its top edge. Each of the six pairs of wheels can be supported on the rail 128 as described above and can travel and roll along the rail 128 as the door slides between its open and closed positions or between its closed and open positions. While one specific implementation of the wheel assemblies 134 and 138 is illustrated herein, various alternative systems and components can be used to mount and/or hang the door panel 116 to slide along the rail 128. While six pairs of wheels are described, the systems described herein can include more than six pairs of wheels or fewer than six pairs of wheels depending on the demands of the specific implementation.

Figure 6:
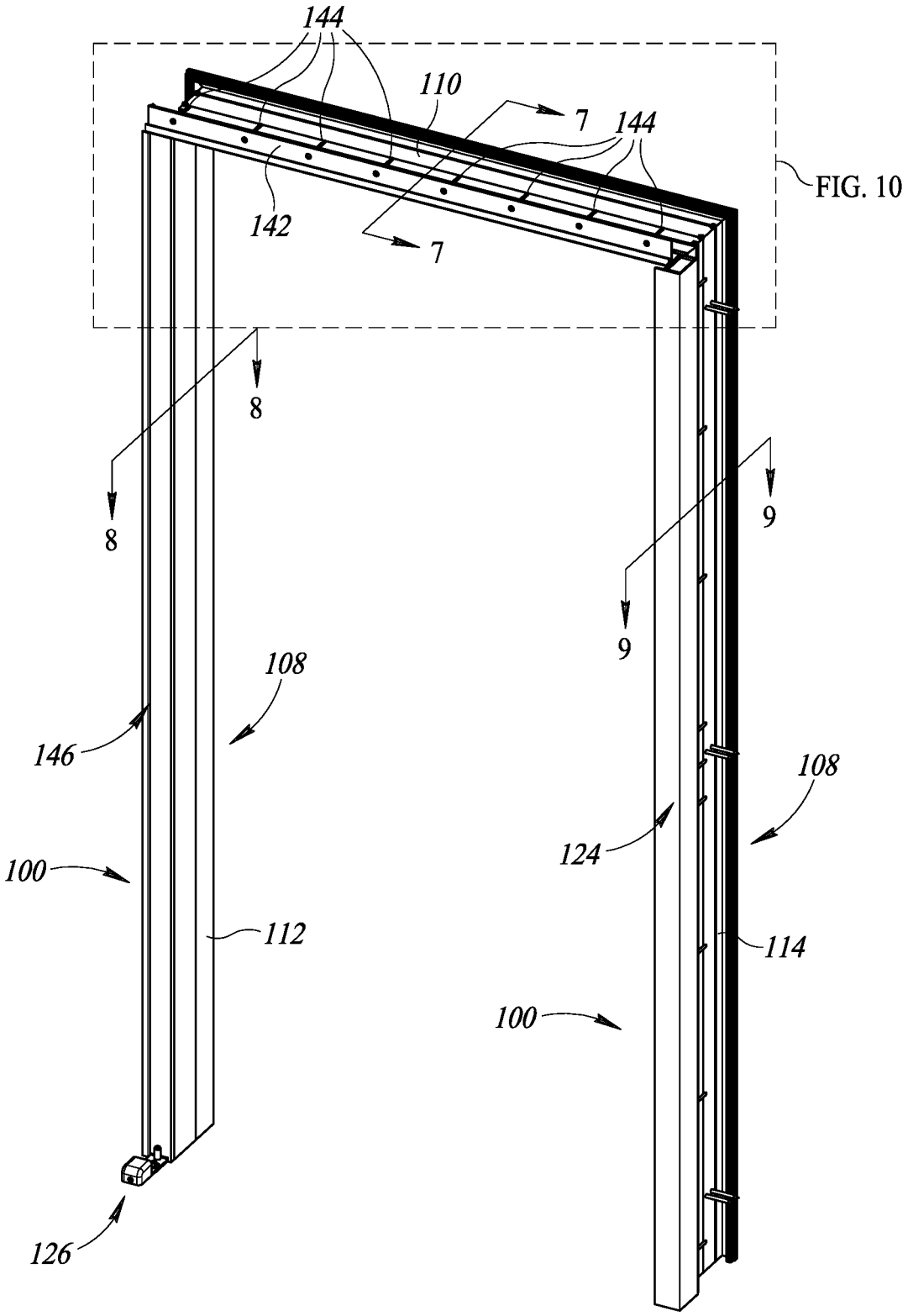
FIG. 6 illustrates the sliding door system of FIG. 1 coupled to the door frame of FIG. 1, with outer housing, hanging railing, rolling, and door components removed, in accordance with one or more implementations of the technologies described herein.

FIG. 6 illustrates a perspective view of the components illustrated in FIG. 3, but with a cover or housing of the header 122 of the sliding door system 100, the rail 128 and bolts 130, and the door panel 116 removed to more clearly illustrate other features. As illustrated in FIG. 6, the header 122 of the sliding door system 100 includes a second, secondary, or backup rail 142 screwed into the wall 102, such as into a horizontal stud at the head of the opening in the wall 102, by a plurality of, such as eight, mechanical fasteners such as screws or bolts 144, which may be equally spaced apart from each other along the length of the rail 142. The rail 142 extends from left-to-right along the length of the header 110 of the door frame 108. FIG. 6 also illustrates the trailing edge column 146, and that the guide wheel assembly 126 is coupled to a front surface of a bottom end of the trailing edge column 146.

Figure 7:
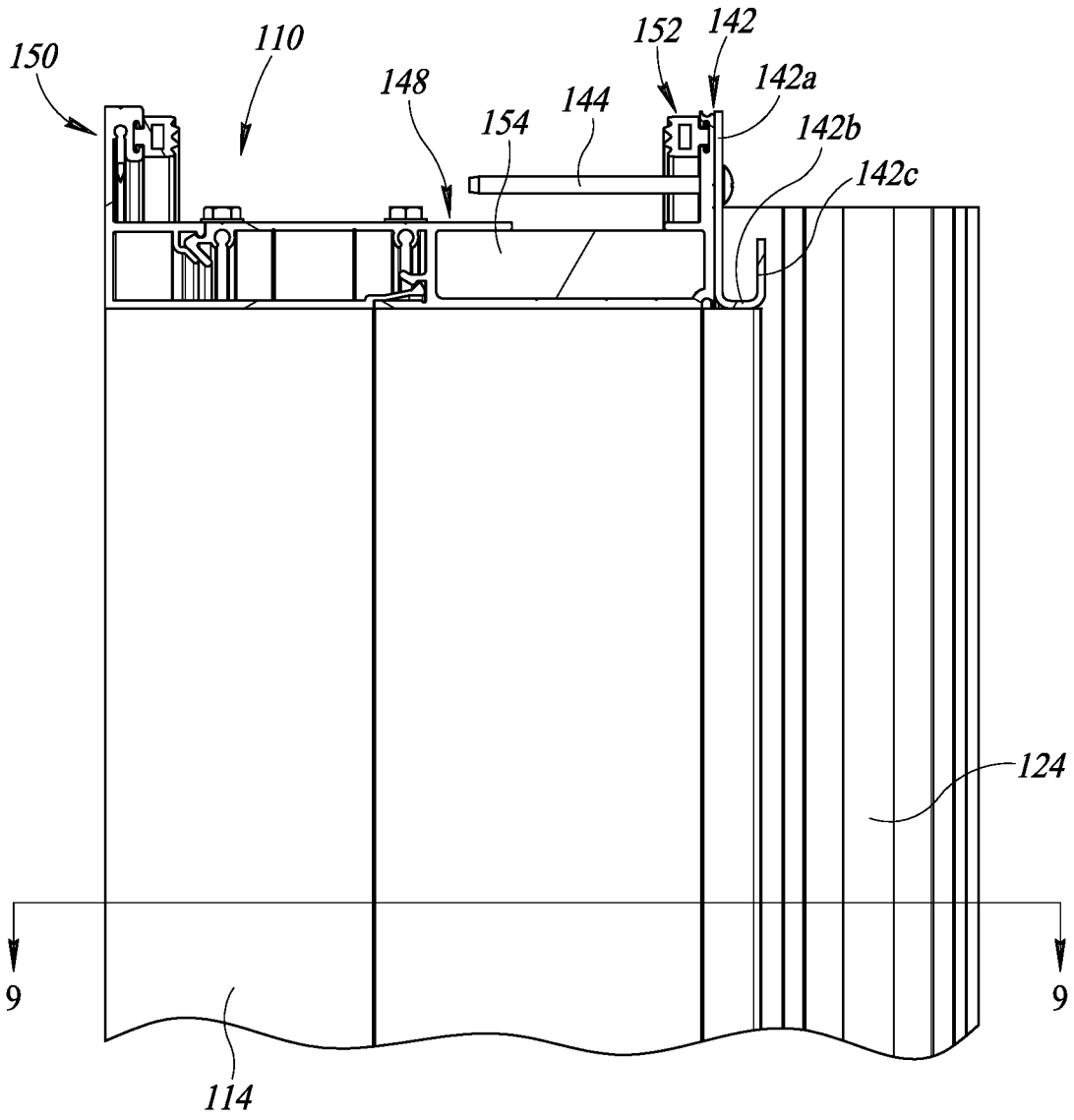
FIG. 7 illustrates a cross-sectional view of the components illustrated in FIG. 6, taken along line 7-7 in FIG. 6, in accordance with one or more implementations of the technologies described herein.

FIG. 7 illustrates a cross-sectional view of the components of the header 122 of the sliding door system 100 and of the header 110 of the door frame 108 illustrated in FIG. 6, taken along line 7-7 in FIG. 6. As illustrated in FIG. 7, the header 110 of the door frame 108 includes a main body 148 that extends from the trailing end of the door frame to the leading end of the door frame (into and out of the page in FIG. 7). The main body 148 has a top or upper surface that faces toward and lies against the underside of the edge of the wall 102 forming the top end of the opening in the wall 102, and a bottom or lower surface that faces in the opposite direction into the opening in the wall 102 that is covered by the door panel 116 when the door panel 116 is in the closed position. The main body 148 of the header 110 extends front-to-back along the thickness of the wall 102 (left-to-right in FIG. 7) from a front edge of the wall 102 to a back or rear edge of the wall 102, and has a thickness that extends up-and-down along the height of the opening in the wall 102.

As also illustrated in FIG. 7, the header 110 of the door frame 108 also includes a rear flange 150 that extends upward from the rear end of the main body 148. The rear flange 150 has a forward-facing surface that faces toward and lies against the rear surface of the wall 102, adjacent the top end of the opening in the wall 102, and a rear-facing surface that faces in the opposite direction rearward and away from the wall 102. Similarly, the header 110 of the door frame 108 also includes a front flange 152 that extends upward from the front end of the main body 148. The front flange 152 has a rearward-facing surface that faces toward and lies against the front surface of the wall 102, adjacent the top end of the opening in the wall 102, and a forward-facing surface that faces in the opposite direction forward and away from the wall 102. While one specific implementation of the header 110 of the door frame 108 is illustrated herein, various alternative systems and components can be used as a header for the door frame 108.

The main body 148 of the header 110 is hollow, and has open spaces or cavities formed therein. As illustrated in FIG. 7, one such cavity, which extends along the length of the main body 148 from the trailing end thereof to the leading end thereof, that extends through the thickness of the main body 148 from a top thereof to a bottom thereof, and that is located at the front of the main body 148 and partially underneath the front flange 152, is filled with a body 154 of a material having a high thermal capacity and/or a low thermal conductivity. The body 154 can act as a heat sink and as an insulator to absorb heat from other components of the sliding door system 100, the wall 102, and/or the door frame 108, such as to prevent or reduce the transfer of heat from the sliding door system 100 to the wall 102 in the case of a fire. The body 154 may comprise any suitable metallic materials, such as aluminum or aluminum alloys, or may comprise a piece of any suitable known, commercially available calcium silicate or gypsum fire protective board, or those available under the brand names PROMATECT (e.g., PROMATECT-H) and/or ROCKWOOL, or any suitable known, commercially available boron/vermiculite infused cementitious products.

As also illustrated in FIG. 7, the rail 142 has an overall cross-sectional shape that resembles a hook or a "J," and that includes a first vertical flange 142*a*, a horizontal web 142*b*, and a second vertical flange 142*c*. The first vertical flange 142*a* has a rearward-facing surface that faces and lies against the forward-facing surface of the front flange 152, and a forward-facing surface that faces in the opposite direction and forward away from the wall 102. The horizontal web 142*b* is coupled at a rear end thereof to a bottom end of the first vertical flange 142*a* and extends forward away from the first vertical flange 142*a*. The second vertical flange 142*c* is coupled at a bottom end thereof to a front end of the horizontal web 142*b* and extends upward away from the horizontal web 142*b*. As also illustrated in FIG. 7, the bolts 144 that couple the rail 142 to the wall 102 extend through the first vertical flange 142*a* of the rail 142, through the front flange 152 of the header 110, through a bottom end portion of the first vertical flange 128*a* of the rail 128, and into the wall 102, such as into one of the studs 104 and/or into a horizontal stud at the head of the opening in the wall 102.

Figure 8:
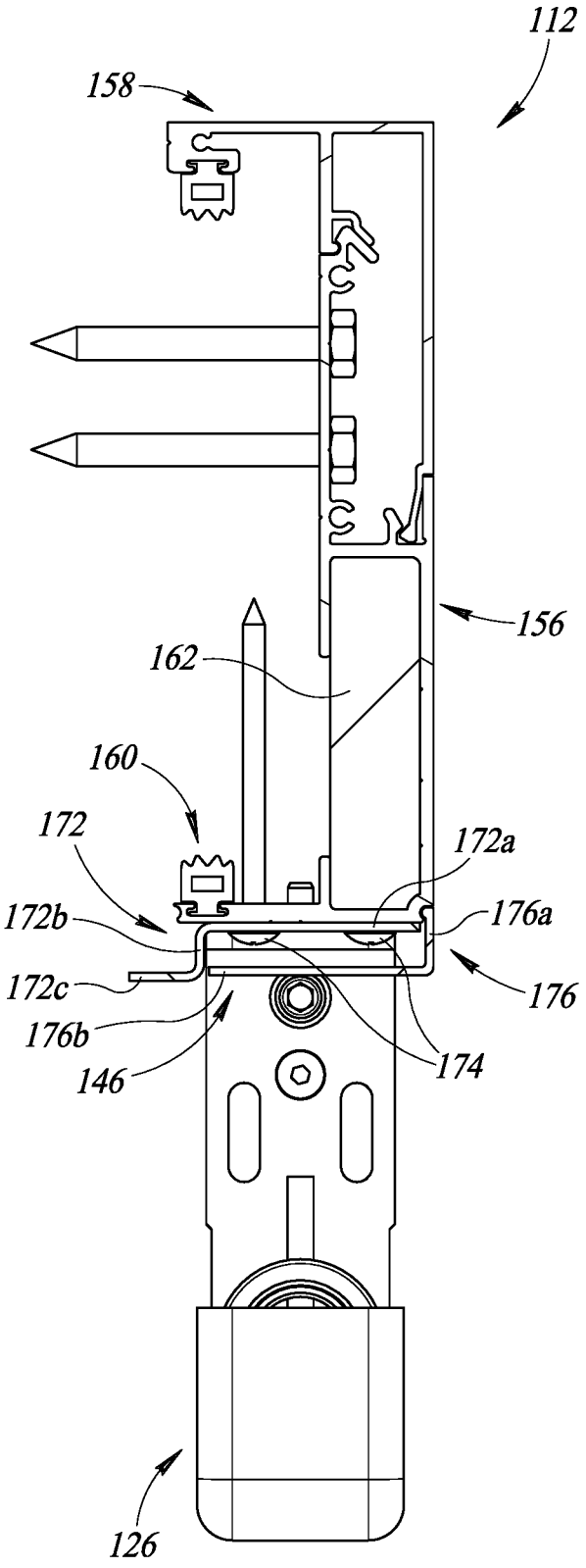
FIG. 8 illustrates a cross-sectional view of the components illustrated in FIG. 6, taken along line 8-8 in FIG. 6, in accordance with one or more implementations of the technologies described herein.

FIG. 8 illustrates a cross-sectional view of the components of the trailing edge column 146 of the sliding door system 100 and of the trailing jamb 112 of the door frame 108 illustrated in FIG. 6, taken along line 8-8 in FIG. 6. As illustrated in FIG. 8, the trailing jamb 112 of the door frame 108 includes a main body 156 that extends from the top end of the door frame to the bottom end of the door frame (into and out of the page in FIG. 8). The main body 156 has a outward-facing surface that faces toward and lies against the outer edge of the wall 102 forming the trailing end of the opening in the wall 102, and an inward-facing surface that faces in the opposite direction into the opening in the wall 102 that is covered by the door panel 116 when the door panel 116 is in the closed position. The main body 156 of the trailing jamb 112 extends front-to-back along the thickness of the wall 102 (up-and-down in FIG. 8) from a front edge of the wall 102 to a back or rear edge of the wall 102, and has a thickness that extends left-to-right along the width of the opening in the wall 102.

As also illustrated in FIG. 8, the trailing jamb 112 of the door frame 108 also includes a rear flange 158 that extends outward from the rear end of the main body 156. The rear flange 158 has a forward-facing surface that faces toward and lies against the rear surface of the wall 102, adjacent the trailing side of the opening in the wall 102, and a rear-facing surface that faces in the opposite direction rearward and away from the wall 102. Similarly, the trailing jamb 112 of the door frame 108 also includes a front flange 160 that extends outward from the front end of the main body 156. The front flange 160 has a rearward-facing surface that faces toward and lies against the front surface of the wall 102, adjacent the trailing side of the opening in the wall 102, and a forward-facing surface that faces in the opposite direction forward and away from the wall 102. While one specific implementation of the trailing jamb 112 of the door frame 108 is illustrated herein, various alternative systems and components can be used as a trailing jamb for the door frame 108.

The main body 156 of the trailing jamb 112 is hollow, and has open spaces or cavities formed therein. As illustrated in FIG. 8, one such cavity, which extends along the length of the main body 156 from the top end thereof to the bottom end thereof, that extends through the thickness of the main body 156 from a left side thereof to a right side thereof, and that is located at the front of the main body 156 and partially inward of the front flange 160, is filled with a body 162 of a material having a high thermal capacity and/or a low thermal conductivity. The body 162 can act as a heat sink and as an insulator to absorb heat from other components of the sliding door system 100, the wall 102, and/or the door frame 108, such as to prevent or reduce the transfer of heat from the sliding door system 100 to the wall 102 in the case of a fire. The body 162 may comprise any suitable metallic materials, such as aluminum or aluminum alloys, or may comprise a piece of any suitable known, commercially available calcium silicate or gypsum fire protective board, or those available under the brand names PROMATECT (e.g., PROMATECT-H) and/or ROCKWOOL, or any suitable known, commercially available boron/vermiculite infused cementitious products. In some implementations, the body 162 may comprise the same material as, or a different material than, the body 154.

As also illustrated in FIG. 8, the trailing edge column 146 includes a trailing edge door seal 172, which can comprise a contoured metal section that extends along the height of the trailing edge column 146 from a top to a bottom thereof, and that includes a first flange 172*a*, a web 172*b*, and a second flange 172*c*. The first flange 172*a* has a rearward-facing surface that faces and lies against the forward-facing surface of the front flange 160, and a forward-facing surface that faces in the opposite direction and forward away from the wall 102. The web 172*b* is coupled at a rear end thereof to a trailing end of the first flange 172*a* and extends forward away from the first flange 172*a*. The second flange 172*c* is coupled at a leading end thereof to a front end of the web 172*b* and extends outward away from the web 172*b*. Thus, the trailing edge door seal 172 forms a part of a boundary of a recess or a gap between the second flange 172*c* and the front surface of the wall 102 and/or the forward-facing surface of the front flange 160, which is closed at an inner end by the web 172*b* and open at its outer end so that it can receive a complementary component of the door panel 116 to create a seal between the door panel 116 and the wall 102 when the door panel 116 is in the closed position.

As illustrated in FIG. 8, the trailing edge column 146 also includes a pair of mechanical fasteners such as screws or bolts 174 that couple the trailing edge door seal 172 to the wall 102. An outer one of the pair of bolts 174 can extend through the first flange 172*a* of the trailing edge door seal 172, through the front flange 160 of the trailing jamb 112, and into the wall 102, such as into one of the studs 104 described herein. An inner one of the pair of bolts 174 can extend through the first flange 172*a* of the trailing edge door seal 172, through the front flange 160 of the trailing jamb 112, and into the main body 156 of the trailing jamb 112, such as into the body 162 of material. While FIG. 8 illustrates the single pair of bolts 174, the trailing edge column 146 can include a plurality, such as eight, of such pairs of bolts 174, which can be equally spaced apart from one another along the height of the trailing edge column 146.

As also illustrated in FIG. 8, the trailing edge column 146 includes a trailing edge door seal cover 176, which can comprise a contoured metal section that extends along the height of the trailing edge column 146 from a top to a bottom thereof, and that includes a first leg or flange 176*a* and a second leg or flange 176*b*. The first flange 176*a* is coupled at a rear end thereof to the front flange 160 of the trailing jamb 112 and extends forward therefrom. The second flange 176*b* is coupled at a leading end thereof to a front end of the first flange 176*a* and extends outward therefrom. The cover 176 can be coupled to the trailing edge door seal 172, such as by a mechanical fastener such as a screw or a bolt that extends through the second flange 176*b* of the cover 176, through the first flange 172*a* of the trailing edge door seal 172, through the front flange 160, and/or into the wall 102. The cover 176, including its first and second flanges 176*a* and 176*b*, acts to cover, protect, and hide the bolts 174.

Figure 9:
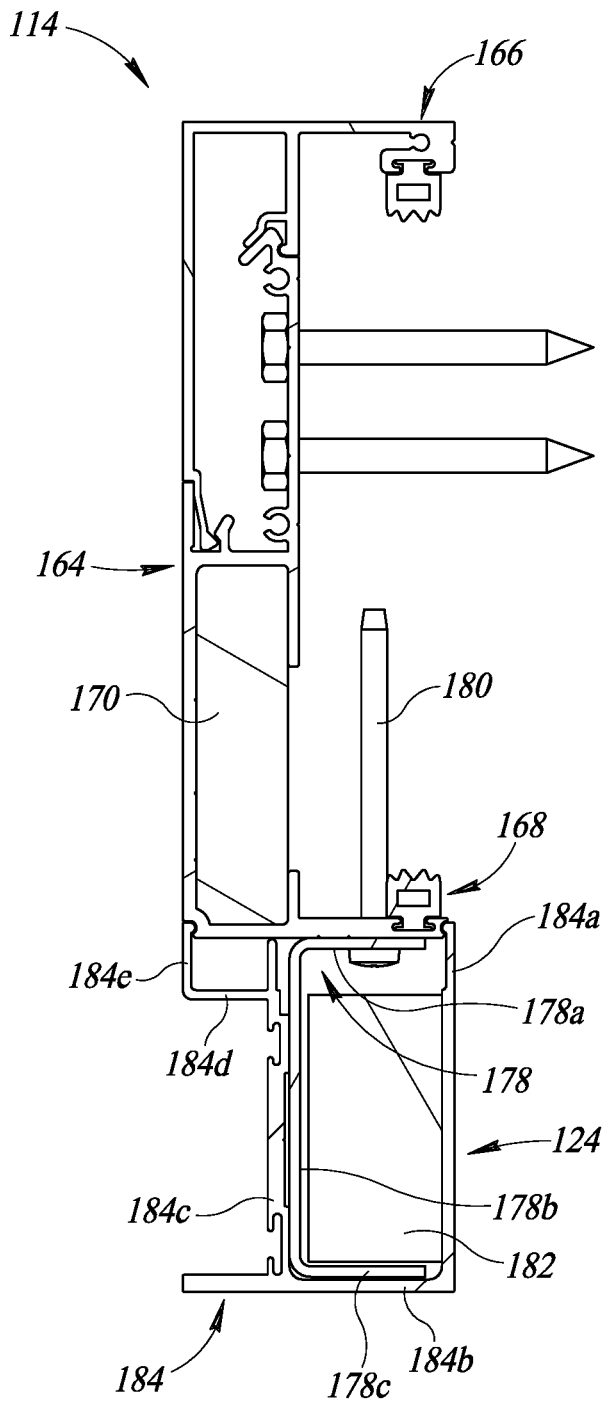
FIG. 9 illustrates a cross-sectional view of the components illustrated in FIG. 6, taken along line 9-9 in FIG. 6, in accordance with one or more implementations of the technologies described herein.

FIG. 9 illustrates a cross-sectional view of the components of the leading edge column 124 of the sliding door system 100 and of the leading jamb 114 of the door frame 108 illustrated in FIG. 6, taken along line 9-9 in FIG. 6. As illustrated in FIG. 9, the leading jamb 114 of the door frame 108 includes a main body 164 that extends from the top end of the door frame to the bottom end of the door frame (into and out of the page in FIG. 9). The main body 164 has an outward-facing surface that faces toward and lies against the outer edge of the wall 102 forming the leading end of the opening in the wall 102, and an inward-facing surface that faces in the opposite direction into the opening in the wall 102 that is covered by the door panel 116 when the door panel 116 is in the closed position. The main body 164 of the leading jamb 114 extends front-to-back along the thickness of the wall 102 (up-and-down in FIG. 9) from a front edge of the wall 102 to a back or rear edge of the wall 102, and has a thickness that extends left-to-right along the width of the opening in the wall 102.

As also illustrated in FIG. 9, the leading jamb 114 of the door frame 108 also includes a rear flange 166 that extends outward from the rear end of the main body 164. The rear flange 166 has a forward-facing surface that faces toward and lies against the rear surface of the wall 102, adjacent the leading side of the opening in the wall 102, and a rear-facing surface that faces in the opposite direction rearward and away from the wall 102. Similarly, the leading jamb 114 of the door frame 108 also includes a front flange 168 that extends outward from the front end of the main body 164. The front flange 168 has a rearward-facing surface that faces toward and lies against the front surface of the wall 102, adjacent the leading side of the opening in the wall 102, and a forward-facing surface that faces in the opposite direction forward and away from the wall 102. While one specific implementation of the leading jamb 114 of the door frame 108 is illustrated herein, various alternative systems and components can be used as a leading jamb for the door frame 108.

The main body 164 of the leading jamb 114 is hollow, and has open spaces or cavities formed therein. As illustrated in FIG. 9, one such cavity, which extends along the length of the main body 164 from the top end thereof to the bottom end thereof, that extends through the thickness of the main body 164 from a left side thereof to a right side thereof, and that is located at the front of the main body 164 and partially inward of the front flange 168, is filled with a body 170 of a material having a high thermal capacity and/or a low thermal conductivity. The body 170 can act as a heat sink and as an insulator to absorb heat from other components of the sliding door system 100, the wall 102, and/or the door frame 108, such as to prevent or reduce the transfer of heat from the sliding door system 100 to the wall 102 in the case of a fire. The body 170 may comprise any suitable metallic materials, such as aluminum or aluminum alloys, or may comprise a piece of any suitable known, commercially available calcium silicate or gypsum fire protective board, or those available under the brand names PROMATECT (e.g., PROMATECT-H) and/or ROCKWOOL, or any suitable known, commercially available boron/vermiculite infused cementitious products. In some implementations, the body 170 may comprise the same material as, or a different material than, one or more of the bodies 154 and 162.

As also illustrated in FIG. 9, the leading edge column 124 includes a channel section 178, which can comprise a contoured metal channel section that extends along the height of the leading edge column 124 from a top to a bottom thereof, and that includes a first flange 178*a*, a web 178*b*, and a second flange 178*c*. The first flange 178*a* has a rearward-facing surface that faces and lies against the forward-facing surface of the front flange 168, and a forward-facing surface that faces in the opposite direction and forward away from the wall 102. The web 178*b* is coupled at a rear end thereof to a trailing end of the first flange 178*a* and extends forward away from the first flange 178*a*. The second flange 178*c* is coupled at a trailing end thereof to a front end of the web 178*b* and extends outward away from the web 178*b*.

As illustrated in FIG. 9, the leading edge column 124 also includes a mechanical fastener such as a screw or bolt 180 that couples the channel section 178 to the wall 102. The bolt 180 can extend through the first flange 178*a* of the channel section 178, through the front flange 168 of the leading jamb 114, and into the wall 102, such as into one of the studs 104 described herein. While FIG. 9 illustrates the single bolt 180, the leading edge column 124 can include a plurality, such as eight, of such bolts 180, which can be equally spaced apart from one another along the height of the leading edge column 124. In some implementations, the leading edge column 124 also includes a body 182 of a material having a high thermal capacity and/or a low thermal conductivity positioned within the recess formed in the channel section 178 between its first and second flanges 178*a*, 178*c*. The body 182 can act as a heat sink and as an insulator to absorb heat from other components of the sliding door system 100, the wall 102, and/or the door frame 108, such as to prevent or reduce the transfer of heat from the sliding door system 100 to the wall 102 in the case of a fire. The body 182 may comprise any suitable metallic materials, such as aluminum or aluminum alloys, or may comprise a piece of any suitable known, commercially available calcium silicate or gypsum fire protective board, or those available under the brand names PROMATECT (e.g., PROMATECT-H) and/or ROCKWOOL, or any suitable known, commercially available boron/vermiculite infused cementitious products. In some implementations, the body 182 may comprise the same material as, or a different material than, one or more of the bodies 154, 162, and 170.

As also illustrated in FIG. 9, the leading edge column 124 includes a leading edge door seal 184, which can comprise a contoured metal section that extends along the height of the leading edge column 124 from a top to a bottom thereof, and that includes a first flange 184*a*, a first web 184*b*, a second flange 184*c*, a second web 184*d*, and a third flange 184*e*. The first flange 184*a* is coupled to a leading end of the front flange 168 of the leading jamb 114 and extends forward therefrom away from the wall 102. The first flange 184*a* covers the open end of the channel section 178 and thus locks the body 182 within the leading edge column 124. The first web 184*b* is coupled at a leading end thereof to a front end of the first flange 184*a* and extends inward away from the first flange 184*a*.

The second flange 184*c* is coupled at a front end thereof to a middle portion of a rearward-facing surface of the first web 184*b* and extends rearward away from the first web 184*b*. A rear end of the second flange 184*c* contacts the forward-facing surface of the front flange 168 of the leading jamb 114. The second web 184*d* is coupled at a leading end thereof to rear portion of an inward-facing surface of the second flange 184*c*, but is spaced apart from the forward-facing surface of the front flange 168 of the leading jamb 114, and extends inward away from the second flange 184*c*. The third flange 184*e* is coupled at a front end thereof to a trailing end of the second web 184*d* and extends rearward away from the second web 184*d*. A rear end of the third flange 184*e* contacts the forward-facing surface of the front flange 168 of the leading jamb 114.

In some implementations, the leading edge column 124 includes a plurality of mechanical fasteners such as screws or bolts 186 (see FIGS. 12, 14, and 16) that couple the leading edge door seal 184 to the channel section 178 and to the body 182. The bolts 186 can extend through the second flange 184*c* of the leading edge door seal 184, through the web 178*b* of the channel section 178, and into the body 182. The leading edge column 124 can include a plurality, such as nine, of such bolts 186, which can be equally spaced apart from one another along the height of the leading edge column 124. The leading edge door seal 184 and the trailing portion of its first web 184*b*, the forward-most portion of its second flange 184*c*, and its second web 184*d* forms a recess or a gap, which is closed at its outer end by the second flange 184*c* and open at its inner end so that it can receive a complementary component of the door panel 116 to create a seal between the door panel 116 and the wall 102 when the door panel 116 is in the closed position.

Figure 10:
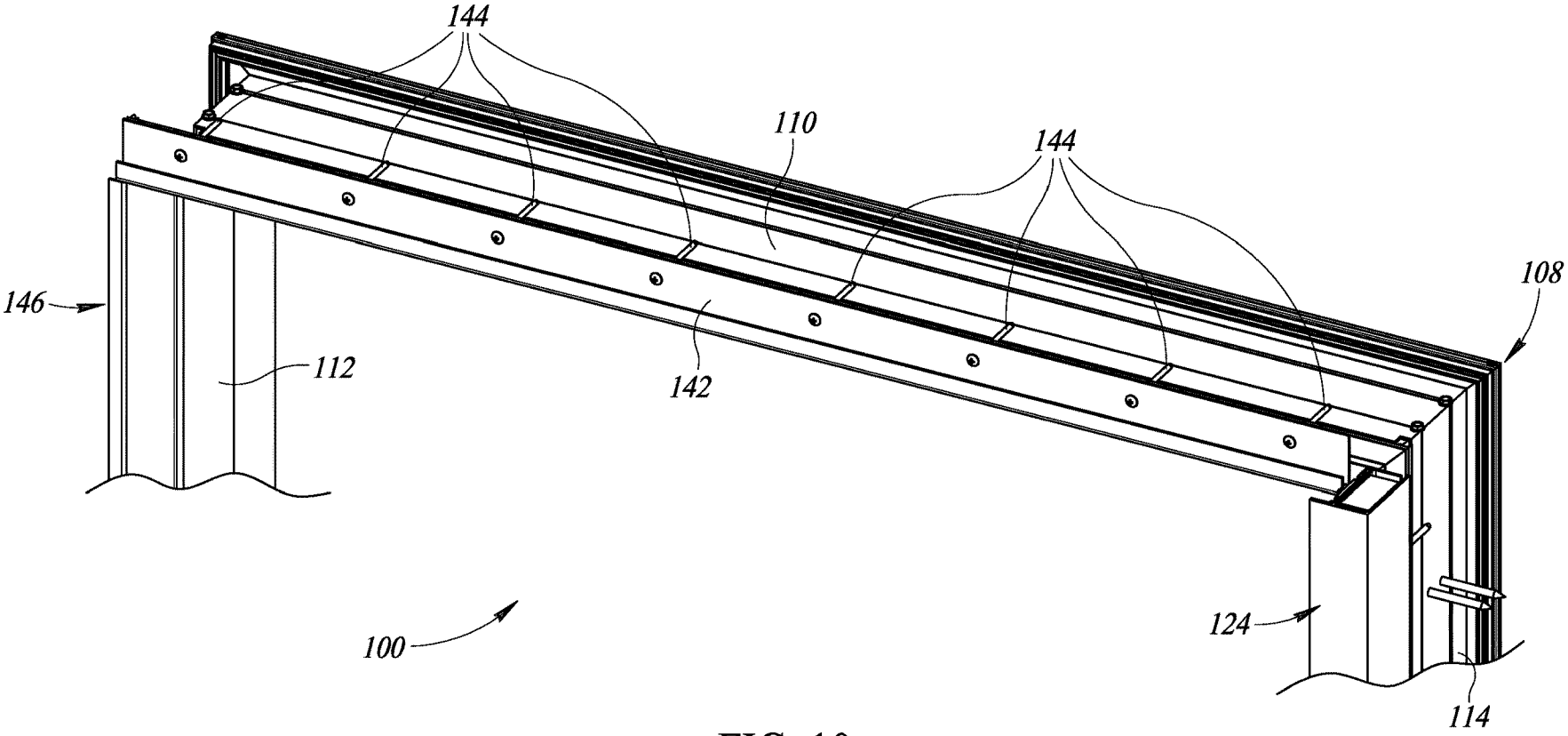
FIG. 10 illustrates a portion of FIG. 6 at a larger scale, in accordance with one or more implementations of the technologies described herein.
Figure 11:
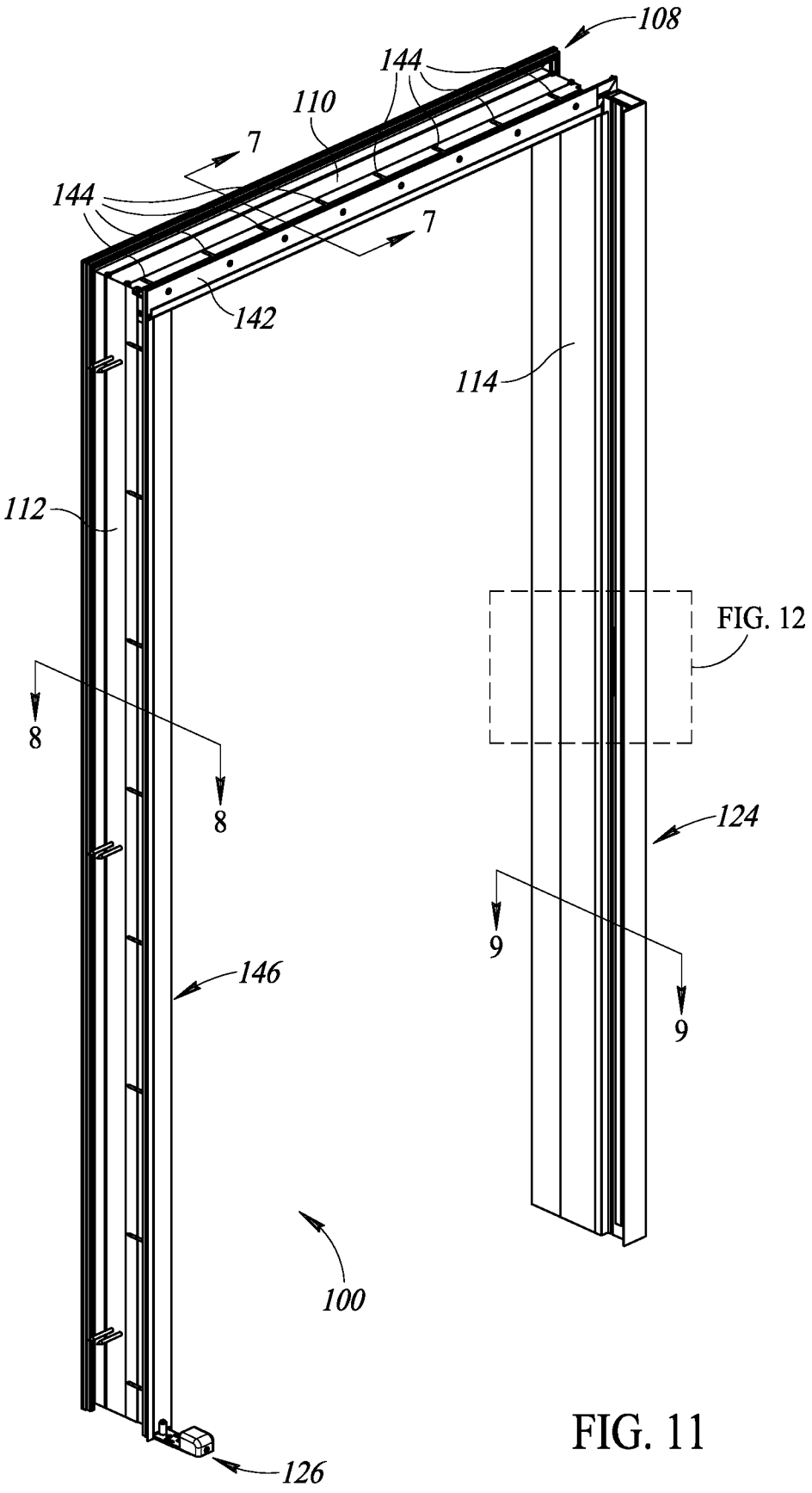
FIG. 11 illustrates a different perspective view of the components illustrated in FIG. 6, in accordance with one or more implementations of the technologies described herein.
Figure 12:
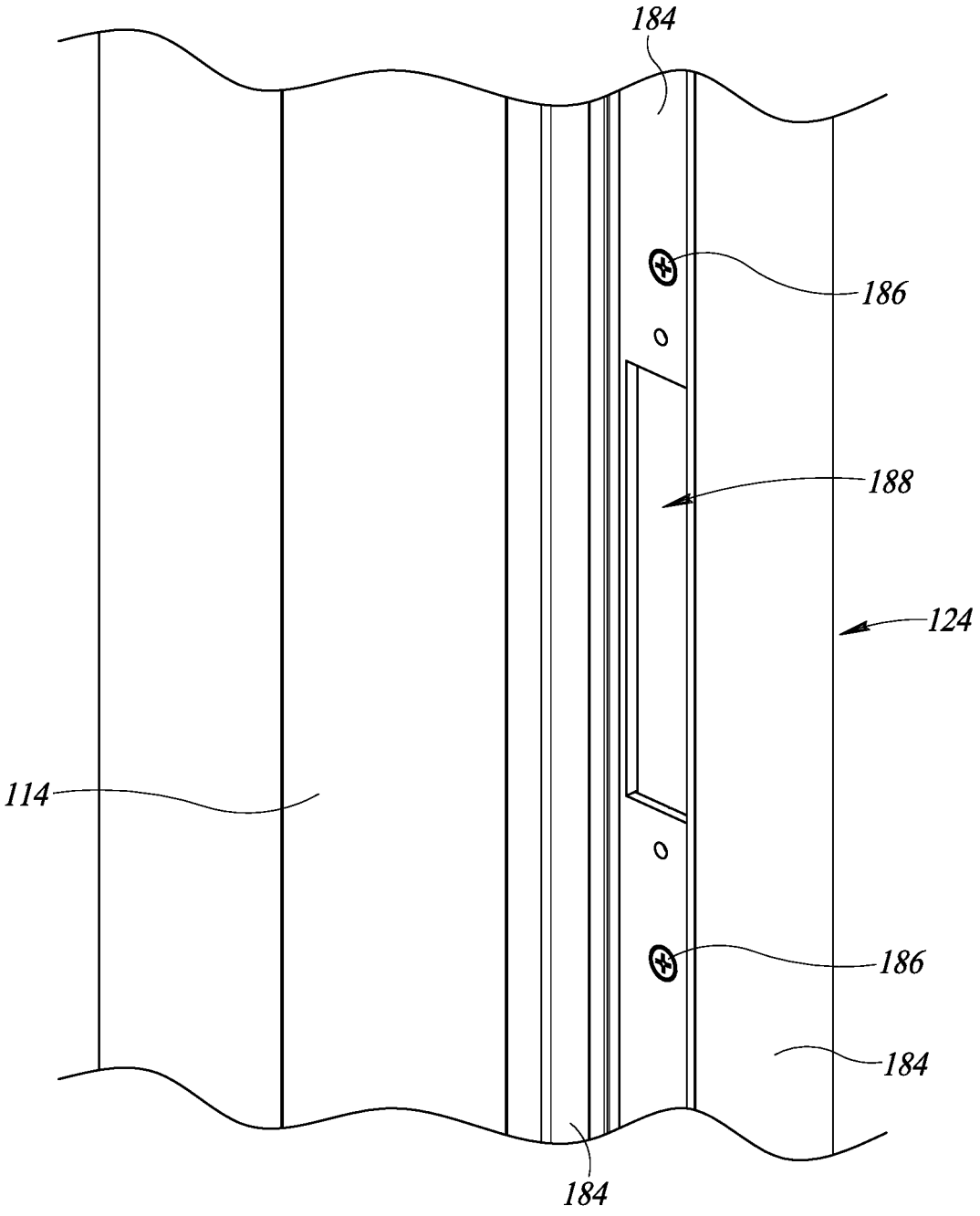
FIG. 12 illustrates a portion of FIG. 11 at a larger scale, in accordance with one or more implementations of the technologies described herein.

FIG. 10 illustrates a portion of FIG. 6, as indicated in FIG. 6, at a larger scale. FIG. 11 illustrates a different perspective view of the components illustrated in FIG. 6. FIG. 12 illustrates a portion of FIG. 11, as indicated in FIG. 11, at a larger scale. As illustrated in FIG. 12, the leading edge door seal 184 includes an opening or an aperture 188 cut in the second flange 184*c* thereof, such as at approximately one third of the overall height of the leading edge door seal 184, to which a strike plate or other components configured to receive or catch a latch or a deadbolt of the door panel 116 can be coupled.

Figure 13:
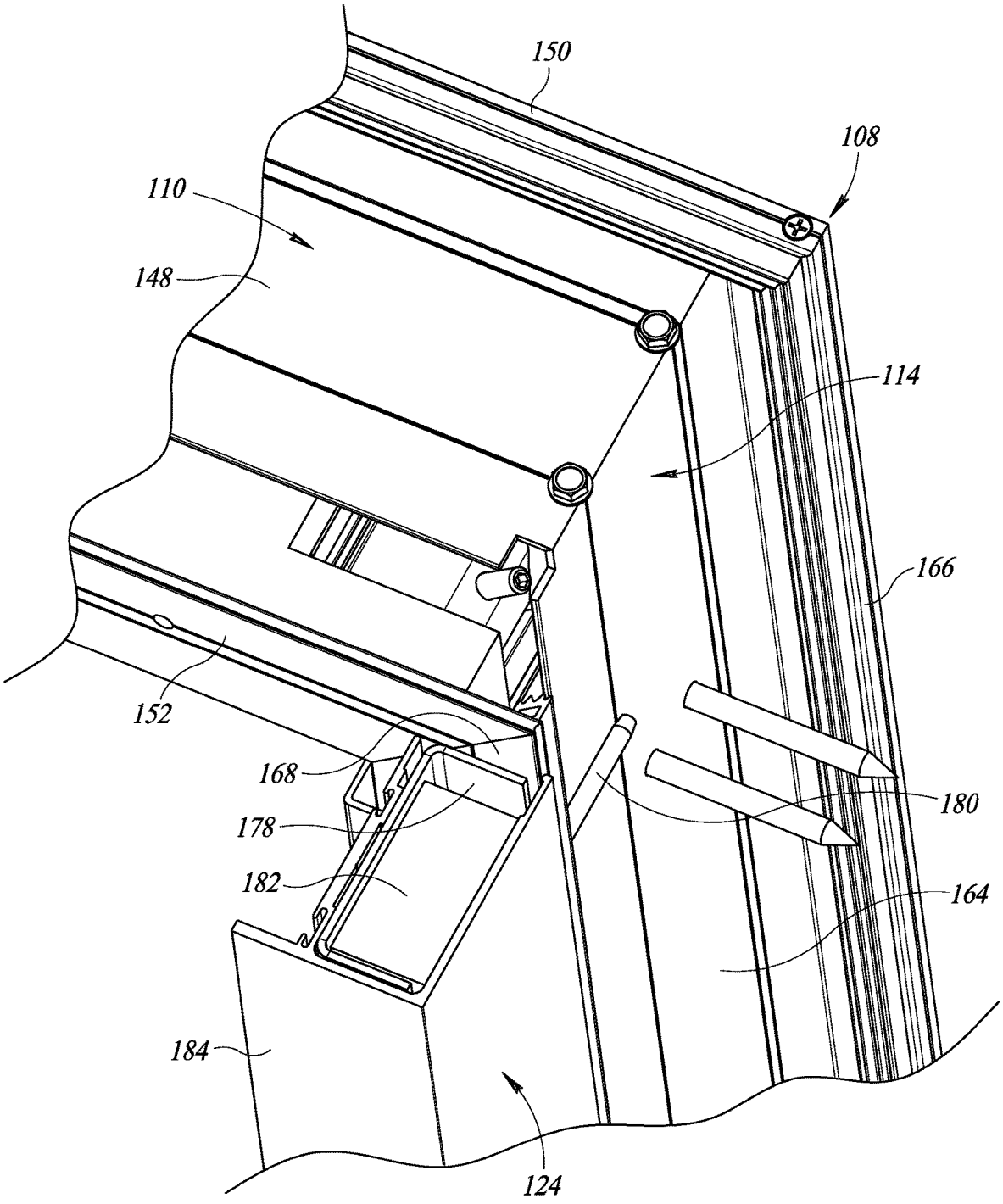
FIG. 13 illustrates a top perspective view of the sliding door system of FIG. 1 coupled to the door frame of FIG. 1, with outer housing, hanging railing, rolling, and door components removed, in accordance with one or more implementations of the technologies described herein.
Figure 14:
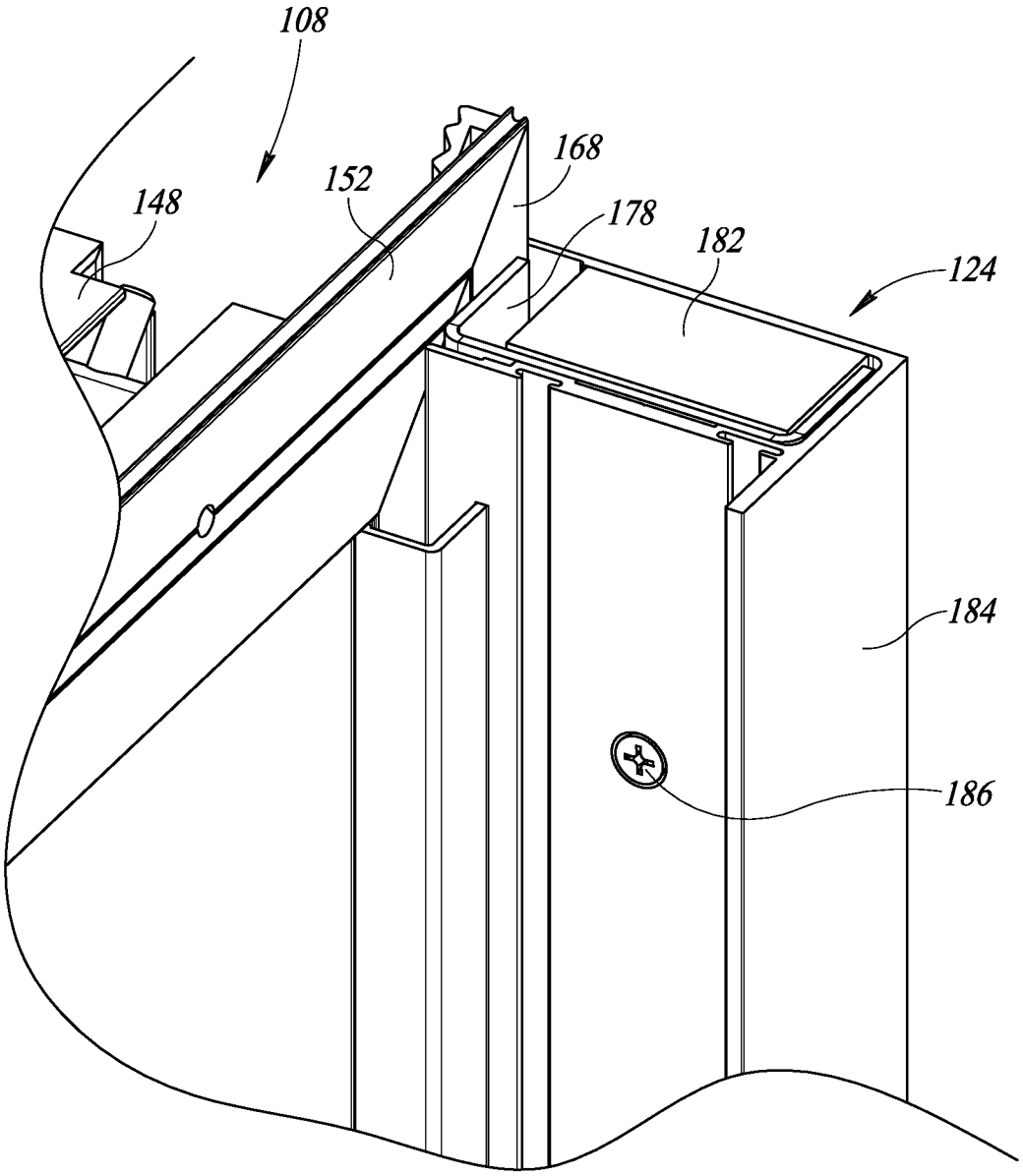
FIG. 14 illustrates a different top perspective view of the components illustrated in FIG. 13, in accordance with one or more implementations of the technologies described herein.
Figure 15:
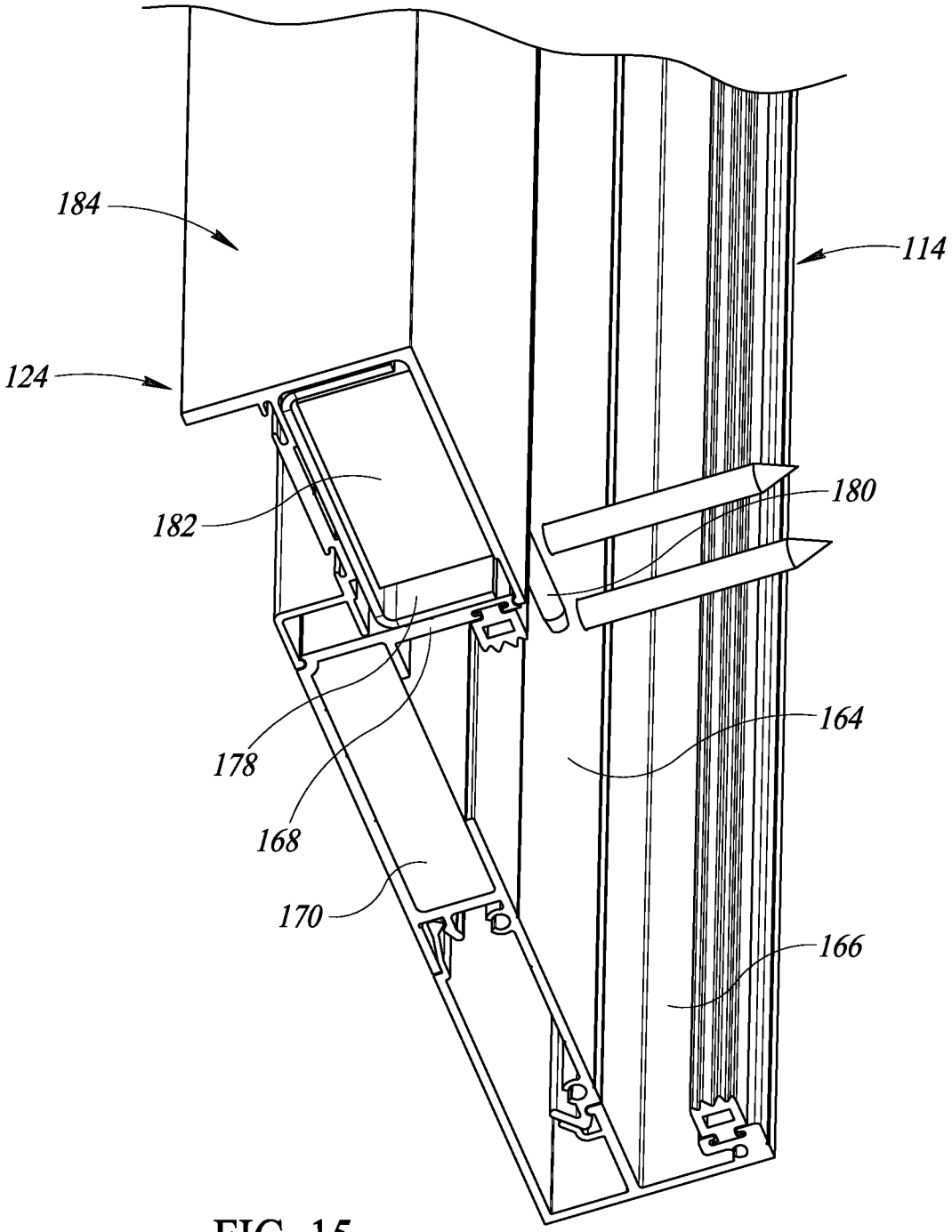
FIG. 15 illustrates a bottom perspective view of the sliding door system of FIG. 1 coupled to the door frame of FIG. 1, with outer housing, hanging railing, rolling, and door components removed, in accordance with one or more implementations of the technologies described herein.
Figure 16:
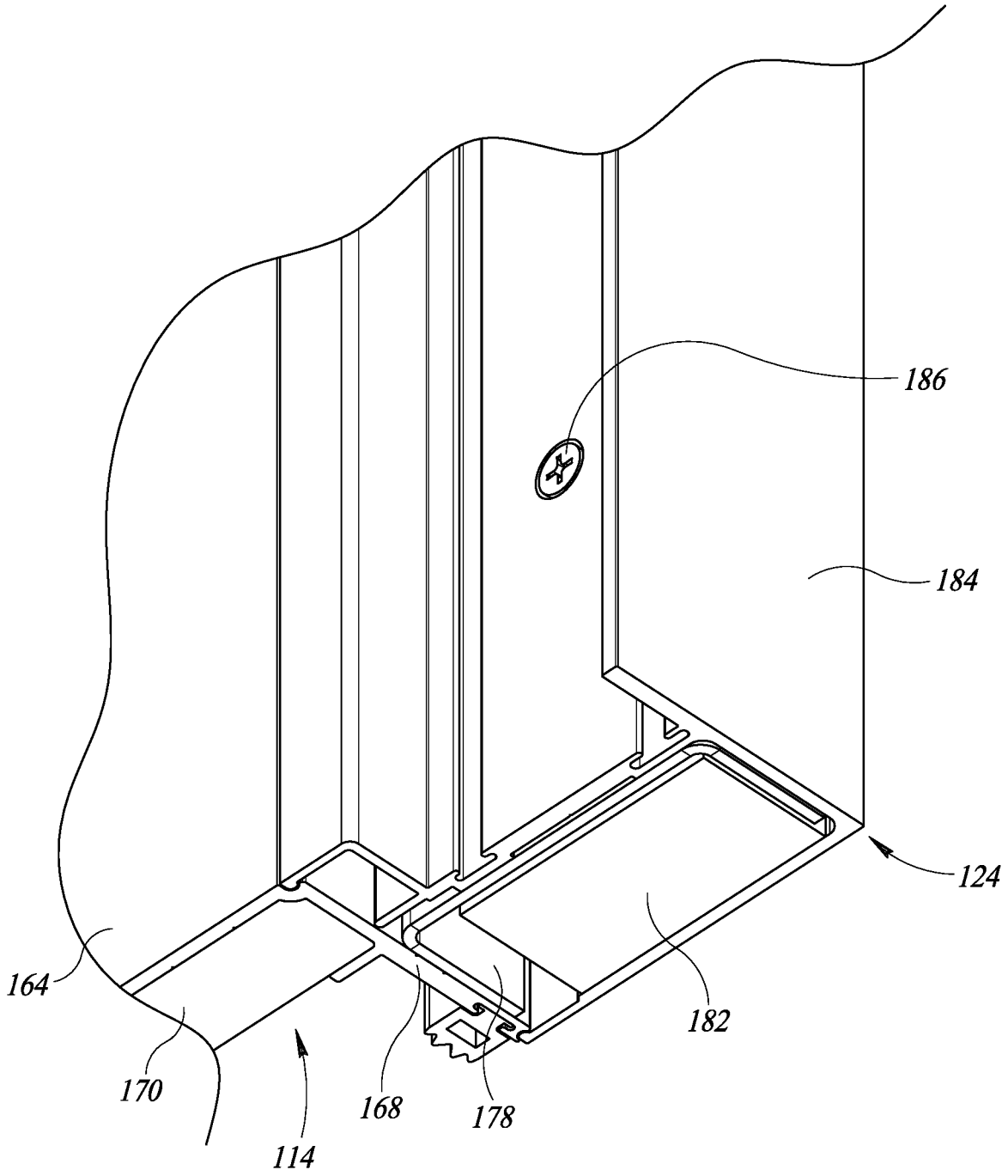
FIG. 16 illustrates a different bottom perspective view of the components illustrated in FIG. 15, in accordance with one or more implementations of the technologies described herein.

FIG. 13 illustrates a top, front, and right side perspective view of the top, leading corner of the door frame 108 and of the leading edge column 124. FIG. 14 illustrates a top, front, and left side perspective view of the top, leading corner of the door frame 108 and of the leading edge column 124. FIG. 15 illustrates a bottom, front, and right side perspective view of the bottom, leading corner of the door frame 108 and of the leading edge column 124. FIG. 16 illustrates a bottom, front, and left side perspective view of the bottom, leading corner of the door frame 108 and of the leading edge column 124.

Figure 17:
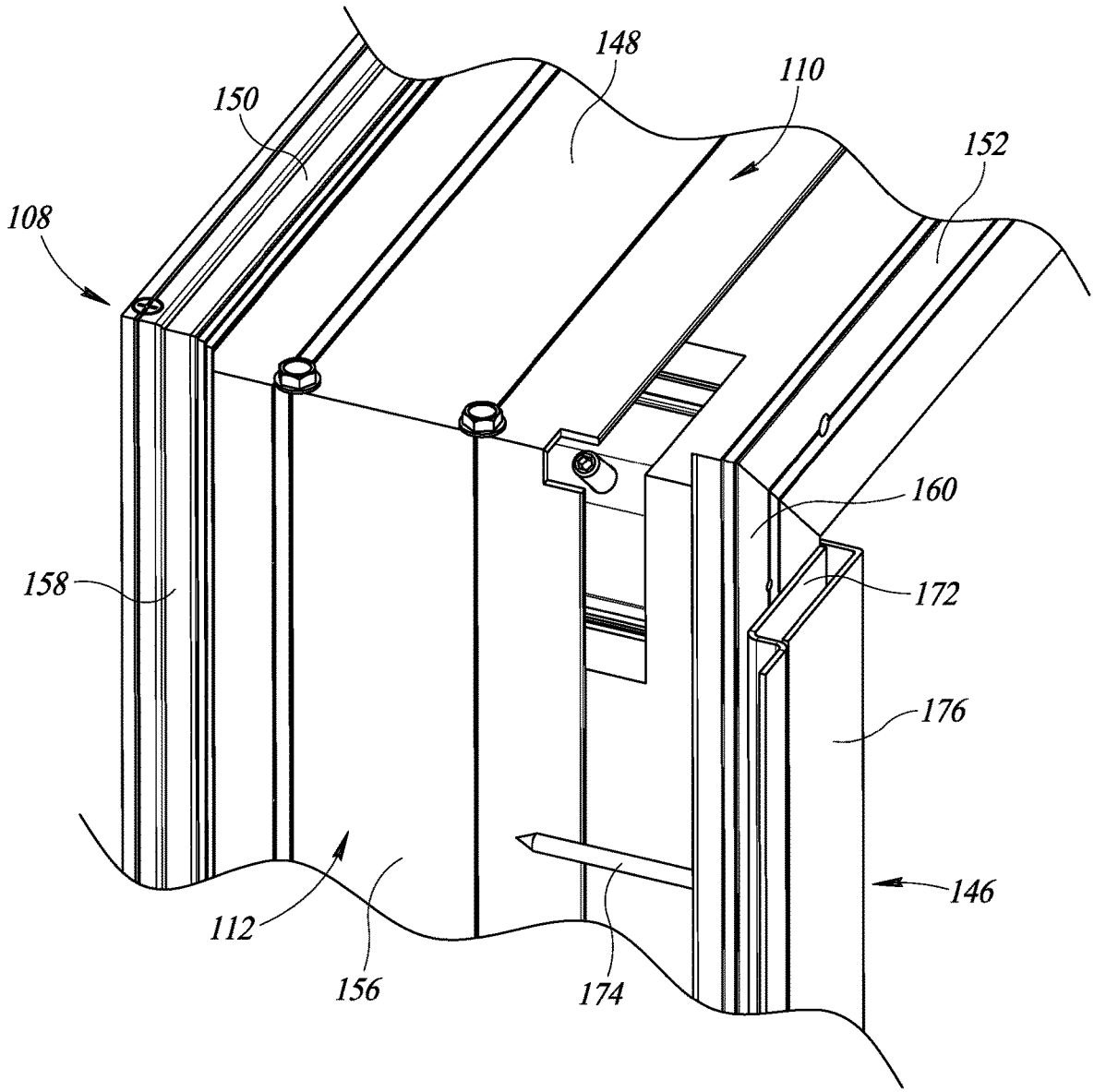
FIG. 17 illustrates a top perspective view of the sliding door system of FIG. 1 coupled to the door frame of FIG. 1, with outer housing, hanging railing, rolling, and door components removed, in accordance with one or more implementations of the technologies described herein.
Figure 18:
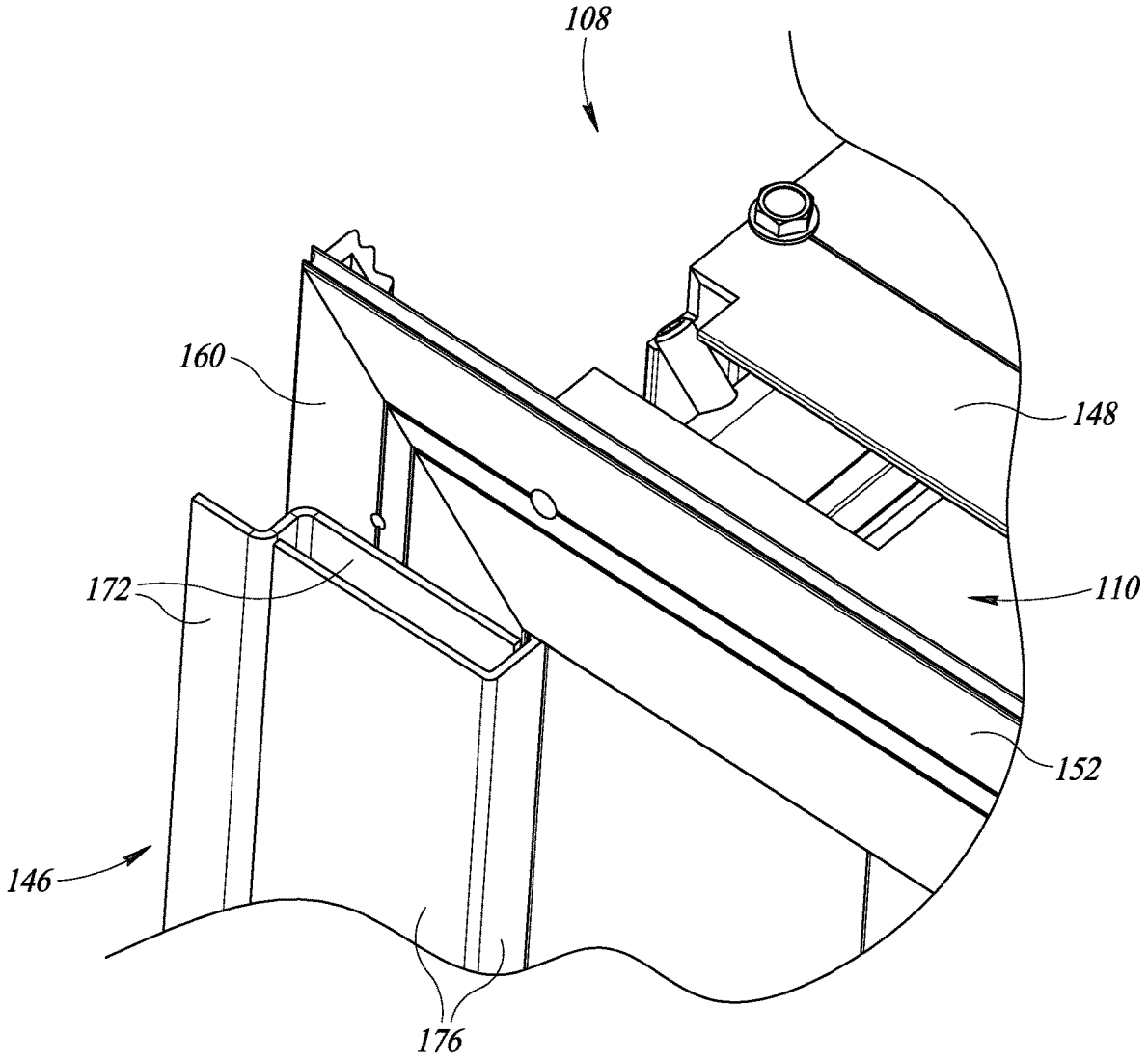
FIG. 18 illustrates a different top perspective view of the components illustrated in FIG. 17, in accordance with one or more implementations of the technologies described herein.
Figure 19:
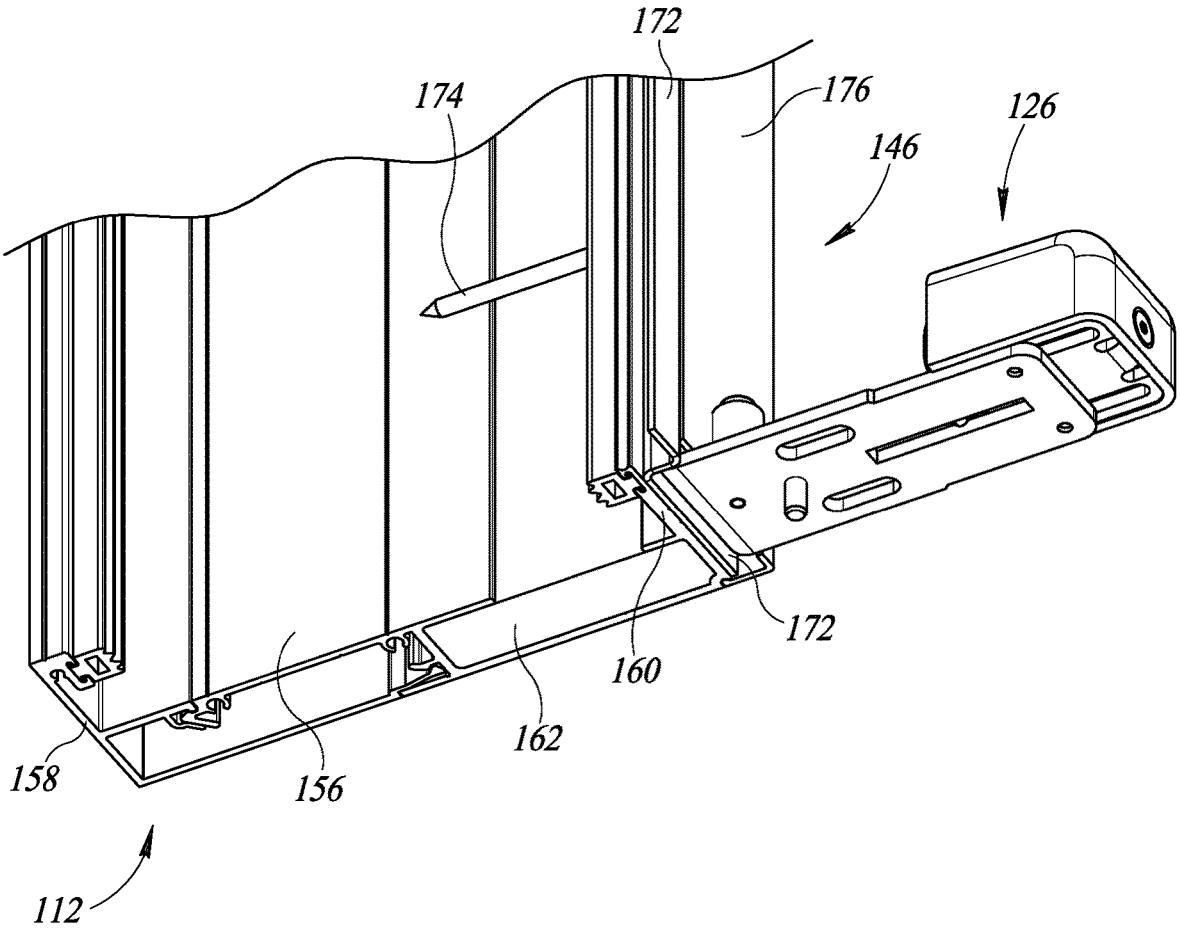
FIG. 19 illustrates a bottom perspective view of the sliding door system of FIG. 1 coupled to the door frame of FIG. 1, with outer housing, hanging railing, rolling, and door components removed, in accordance with one or more implementations of the technologies described herein.
Figure 20:
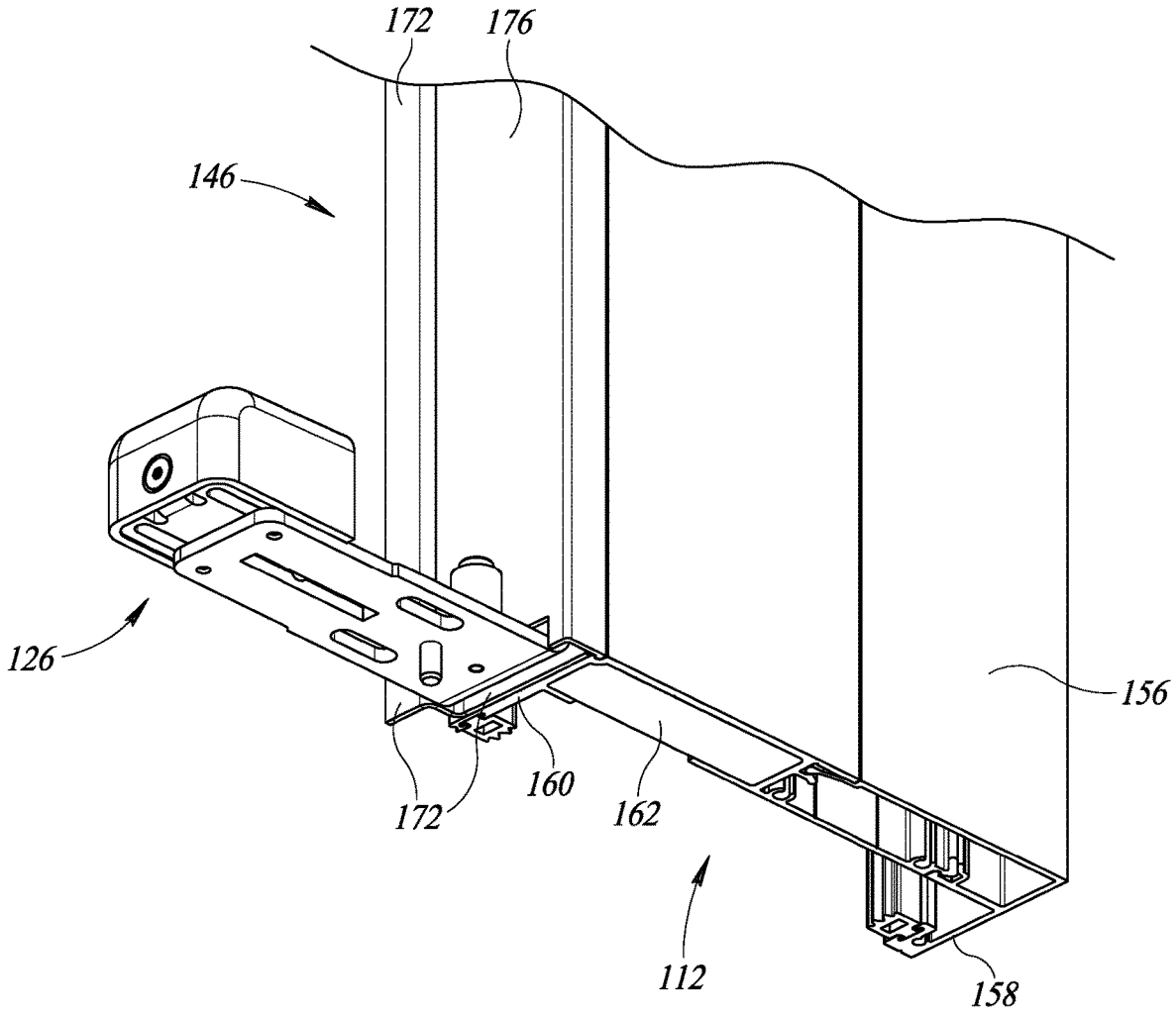
FIG. 20 illustrates a different bottom perspective view of the components illustrated in FIG. 19, in accordance with one or more implementations of the technologies described herein.

FIG. 17 illustrates a top, front, and left side perspective view of the top, trailing corner of the door frame 108 and of the trailing edge column 146. FIG. 18 illustrates a top, front, and right side perspective view of the top, trailing corner of the door frame 108 and of the trailing edge column 146. FIG. 19 illustrates a bottom, front, and left side perspective view of the bottom, trailing corner of the door frame 108 and of the trailing edge column 146. FIG. 20 illustrates a bottom, front, and right side perspective view of the bottom, trailing corner of the door frame 108 and of the trailing edge column 146.

Figure 21:
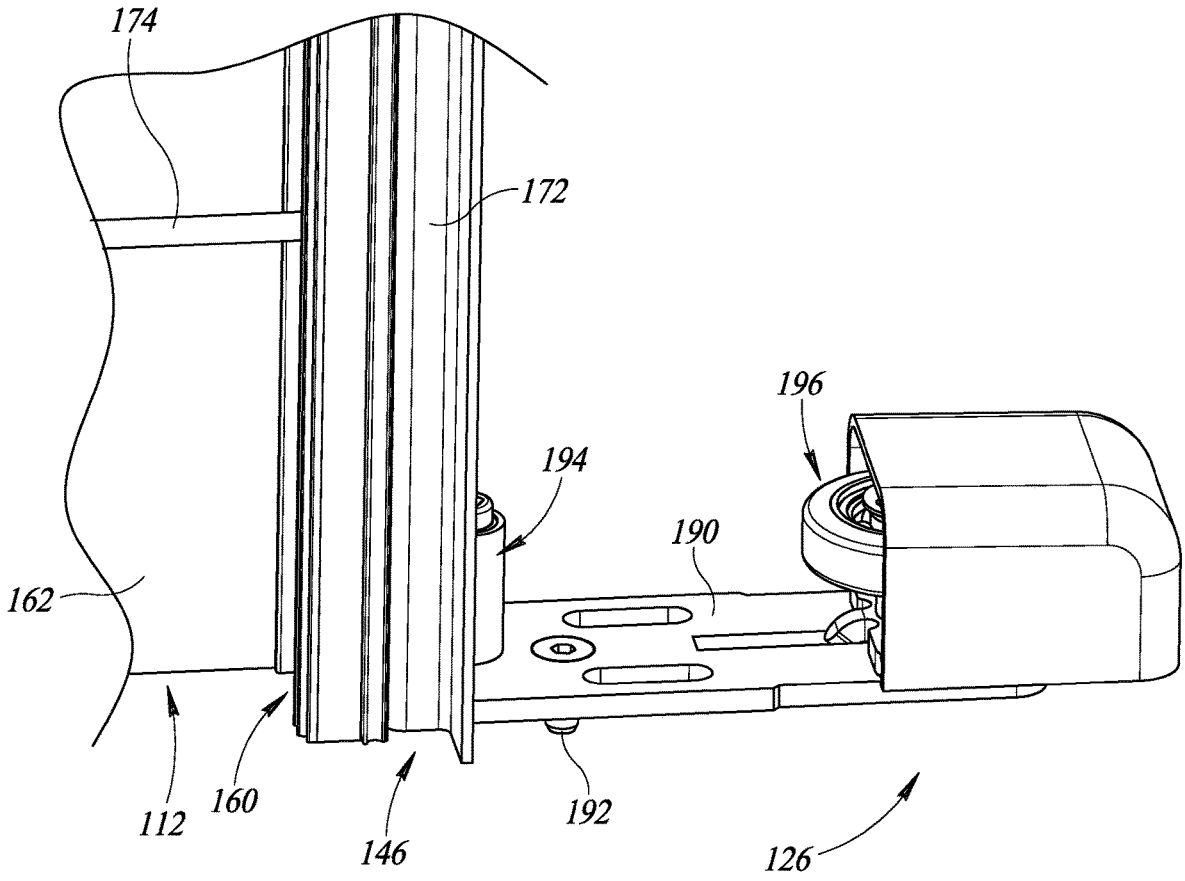
FIG. 21 illustrates a different bottom perspective view of the components illustrated in FIGS. 19 and 20, in accordance with one or more implementations of the technologies described herein.

FIG. 21 illustrates components of the guide wheel assembly 126 at a larger scale than in other Figures. As illustrated in FIG. 21, the guide wheel assembly 126 includes a base plate 190 that is coupled to a bottom end of the trailing edge column 146, that extends outward and forward away from the bottom end of the trailing edge column 146, and that is coupled to a floor surface by a mechanical fastener such as a screw or a bolt 192. As illustrated in FIG. 21, the guide wheel assembly 126 also includes an inner roller or guide wheel 194 supported on an axle extending straight upward from the base plate 190 such that it rotates about a first vertical axis, and an outer roller or guide wheel 196 supported on an axle extending straight upward from the base plate 190 such that it rotates about a second vertical axis parallel to but offset from the first vertical axis. In operation, a bottom end of the door panel 116 can be positioned between the first and second guide wheels 194 and 196, and can move side to side between the guide wheels 194, 196. The guide wheels 194, 196 can restrain the bottom end of the door panel 116 against movement toward or away from the trailing edge column 146, so as to prevent a separation of the door panel 116 from the rest of the sliding door system 100, the wall 102, and the door frame 108, and to prevent collisions between the door panel 116 and the rest of the sliding door system 100, the wall 102, and the door frame 108.

Figure 22:
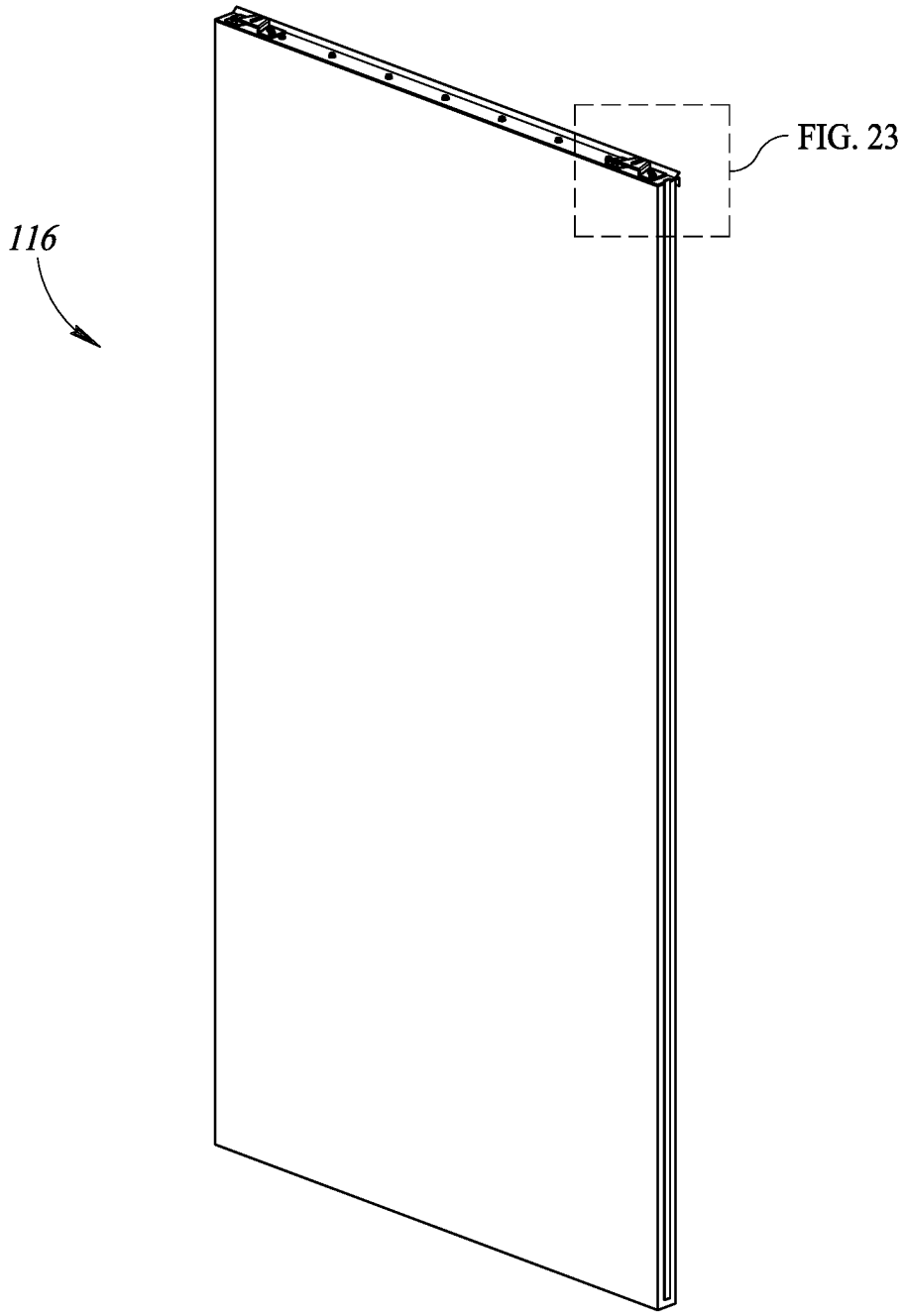
FIG. 22 illustrates door components of the sliding door system of FIG. 1, in accordance with one or more implementations of the technologies described herein.
Figure 23:
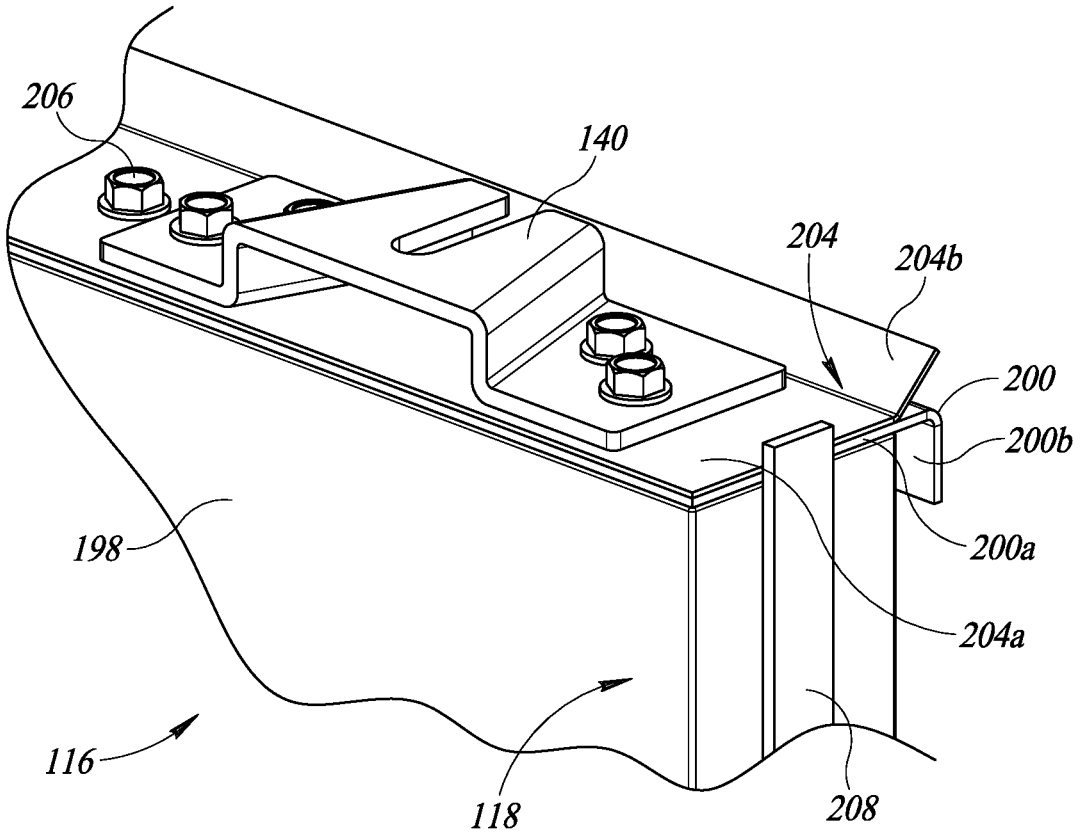
FIG. 23 illustrates a portion of FIG. 22 at a larger scale, in accordance with one or more implementations of the technologies described herein.
Figure 24:
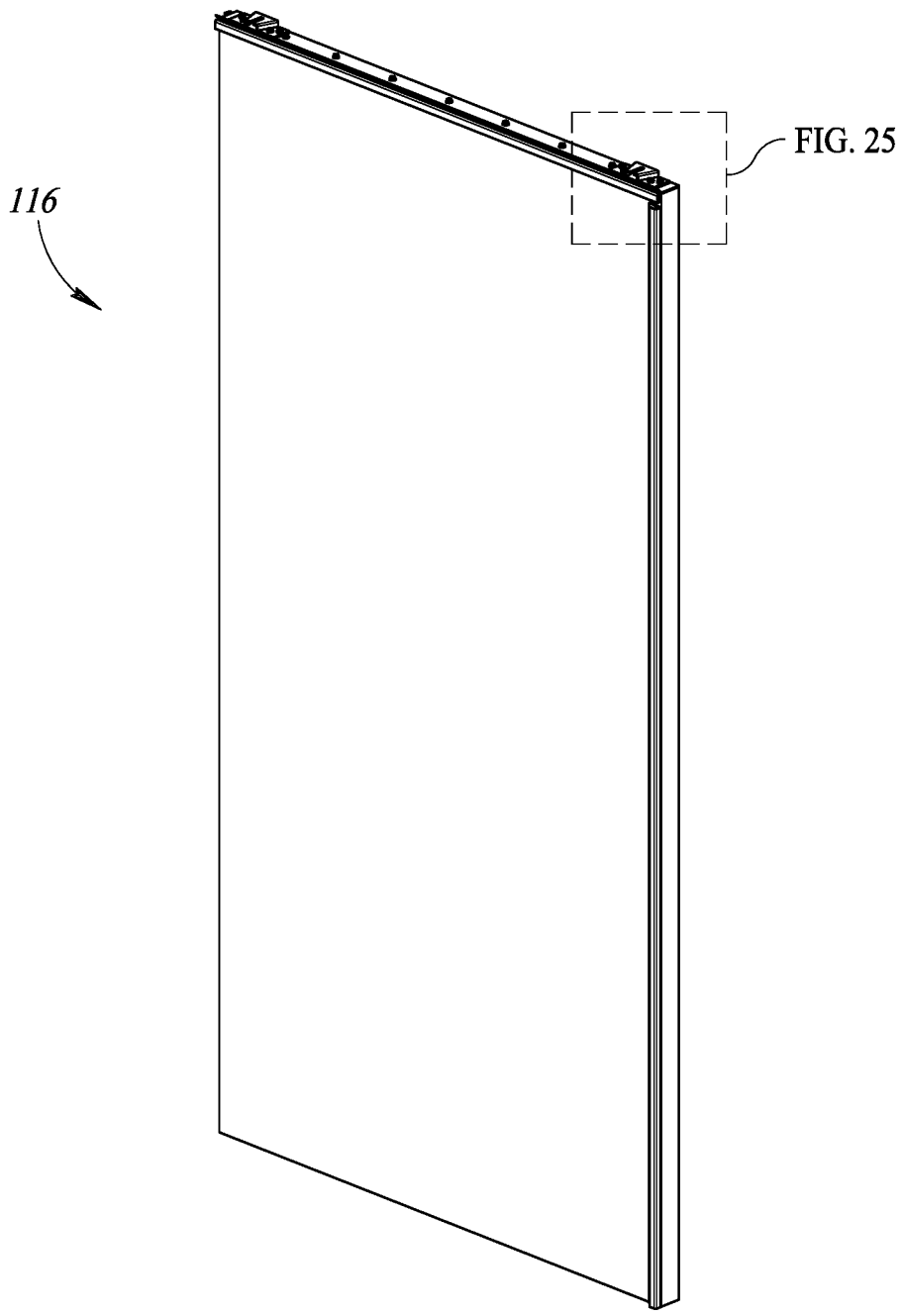
FIG. 24 illustrates a different perspective view of the door components of the sliding door system of FIG. 1, in accordance with one or more implementations of the technologies described herein.
Figure 25:
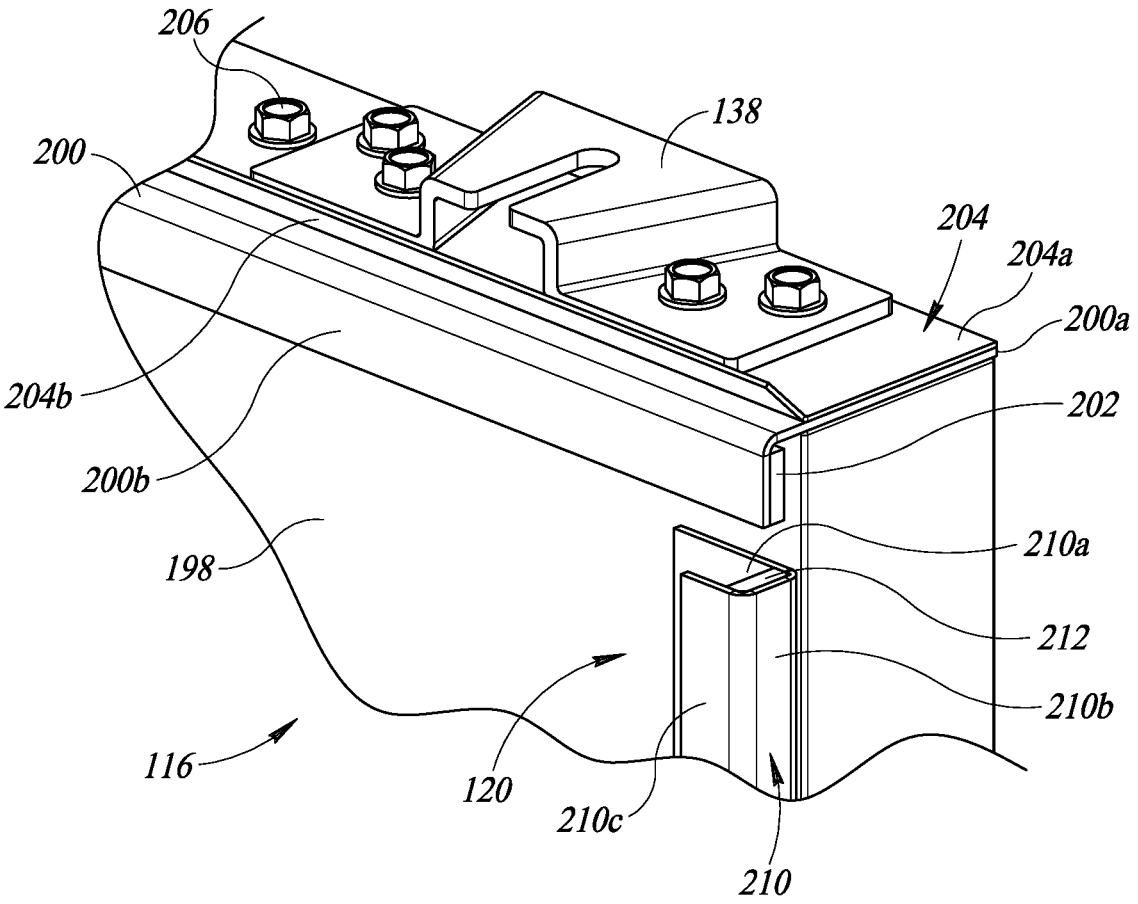
FIG. 25 illustrates a portion of FIG. 24 at a larger scale, in accordance with one or more implementations of the technologies described herein.

FIG. 22 illustrates a front, top, and right side perspective view of the door panel 116. FIG. 23 illustrates a portion of FIG. 22, as indicated in FIG. 22, at a larger scale. FIG. 24 illustrates a rear, top, and left side perspective view of the door panel 116. FIG. 25 illustrates a portion of FIG. 24, as indicated in FIG. 24, at a larger scale. As illustrated in FIGS. 22-25, the door panel 116 includes a door leaf 198 having a front and forward-facing surface and a leading end shown in FIGS. 22 and 23 and a rear and rearward-facing surface and a trailing end shown in FIGS. 24 and 25. The door leaf 198 can be made of any of various suitable materials. As one example, the door leaf 198 can be a mineral core door with a calcium silicate core. As another example, the door leaf 198 can be made of steel or wood, and may include a door lite. In some implementations, the door leaf 198 is solid, and has a solid, flush bottom surface without any grooves or other indentations formed therein. In some cases, the door leaf 198 can be made of solid wood and can include a metallic guard that covers a bottom end portion of the door leaf 198 to protect it against wear and damage resulting from interaction with the guide wheels 194 and 196 of the guide wheel assembly 126.

As illustrated in FIGS. 22-25, the door panel 116 also includes a top end door seal 200, which can comprise a contoured metal angle section that extends along the length or the width of the top end of the door leaf 198 from the leading end thereof to the trailing end thereof, and that includes a first leg or flange 200*a* and a second leg or flange 200*b*. The first flange 200*a* has a downward-facing surface that faces and lies against the top end of the door leaf 198, and an upward-facing surface that faces in the opposite direction and upward away from the door leaf 198. The second flange 200*b* is coupled at a top end thereof to a rear end of the first flange 200*a* and extends downward away from the first flange 200*a*. The top end door seal 200 forms a part of a boundary of a recess or a gap between the top end door seal 200 and the rear surface of the door leaf 198, which is closed at an upper end thereof by the first flange 200*a* and open at its bottom end so that it can receive a complementary component of the hook-shape of the rail 142 to create a seal between the door panel 116 and the wall 102 when the door panel 116 is in the closed position. As illustrated in FIG. 25, the door panel 116 also includes a first strip of intumescent material such as tape 202 coupled to a forward-facing surface of the second flange 200*b* of the top end door seal 200, such as by an adhesive such as glue or epoxy, such that when the door panel 116 is coupled to the rail 142, the first strip of intumescent tape 202 is located between the second flange 200*b* and the second vertical flange 142*c*.

As illustrated in FIGS. 22-25, the door panel 116 also includes a top end door guard 204, which can comprise a contoured metal angle section that extends along the length or the width of the top end of the door leaf 198, such as along a top or an upper surface of the first flange 200*a* of the top end door seal 200, from the leading end thereof to the trailing end thereof, and that includes a first leg or flange 204*a* and a second leg or flange 204*b*. The first flange 204*a* has a downward-facing surface that faces and lies against the top or upper surface of the first flange 200*a* of the top end door seal 200, and an upward-facing surface that faces in the opposite direction and upward away from the door leaf 198. The second flange 204*b* is coupled at a bottom, front end thereof to a rear end of the first flange 204*a* and extends an approximately a 45-degree angle upward and rearward away from the first flange 204*a*. The top end door guard 204 can help in maintaining a seal between the door panel 116 and the wall 102 by reducing or preventing the dripping of melted materials, such as melted plastic materials, to the interface and seal between the door panel 116 and the wall 102. As illustrated in FIGS. 22-25, the top end door seal 200 and the top end door guard 204 can be coupled to the door leaf 198 by a plurality of mechanical fasteners such as screws or bolts 206 that each extend through the top end door guard 204, through the top end door seal 200, and into the top end of the door leaf 198.

As illustrated in FIGS. 22 and 23, the door panel 116 also includes a second strip of intumescent tape 208 that is coupled to the leading end of the door leaf 198 and that extends along a height of the leading end of the door leaf 198 from a top end to a bottom end thereof, such as by an adhesive such as glue or epoxy. When the door panel 116 is in use, the second strip of intumescent tape 208 is located between the door leaf 198 and the inward-facing surface of the second flange 184*c* of the leading edge door seal 184 of the leading edge column 124. In some implementations, the door panel 116 also includes a sliding sash lock, a latch, and/or a deadbolt coupled to the leading end of the door leaf 198, such as at approximately one third of the overall height of the door leaf 198, which can engage with the strike plate or other components coupled to the aperture 188 of the leading edge door seal 184. In such implementations, the second strip of intumescent tape 208 includes a first portion that extends from the top end of the door leaf 198 to adjacent a top end of the locking components and a second portion that extends from the bottom end of the door leaf 198 to adjacent a bottom end of the locking components.

As illustrated in FIGS. 24 and 25, the door panel 116 also includes a trailing end door seal 210, which can comprise a contoured metal channel section that extends along the height of the trailing end of the door leaf 198 from the top end thereof to the bottom end thereof, and that includes a first flange 210*a*, a web 210*b*, and a second flange 210*c*. The first flange 210*a* has a forward-facing surface that faces and lies against the rear surface of the door leaf 198, and a rearward-facing surface that faces in the opposite direction and rearward away from the door leaf 198. The web 210*b* is coupled at a front end thereof to a trailing end of the first flange 210*a* and extends rearward away from the first flange 210*a*. The second flange 210*c* is coupled at a trailing end thereof to a rear end of the web 210*b* and extends inward away from the web 210*b*. The trailing end door seal 210 forms a boundary of a recess or a gap between the first and second flanges 210*a* and 210*c*, which is closed at a trailing end thereof by the web 210*b* and open at its leading end so that it can receive a complementary component of the trailing edge door seal 172 to create a seal between the door panel 116 and the wall 102 when the door panel 116 is in the closed position. As illustrated in FIG. 25, the door panel 116 also includes a third strip of intumescent material such as tape 212 coupled to an inward-facing surface of the web 210*b* of the trailing end door seal 210, such as by an adhesive such as glue or epoxy, such that when the door panel 116 is in use and in a closed position, the third strip of intumescent tape 212 is located between the web 210*b* and the second flange 172*c*.

Figure 26:
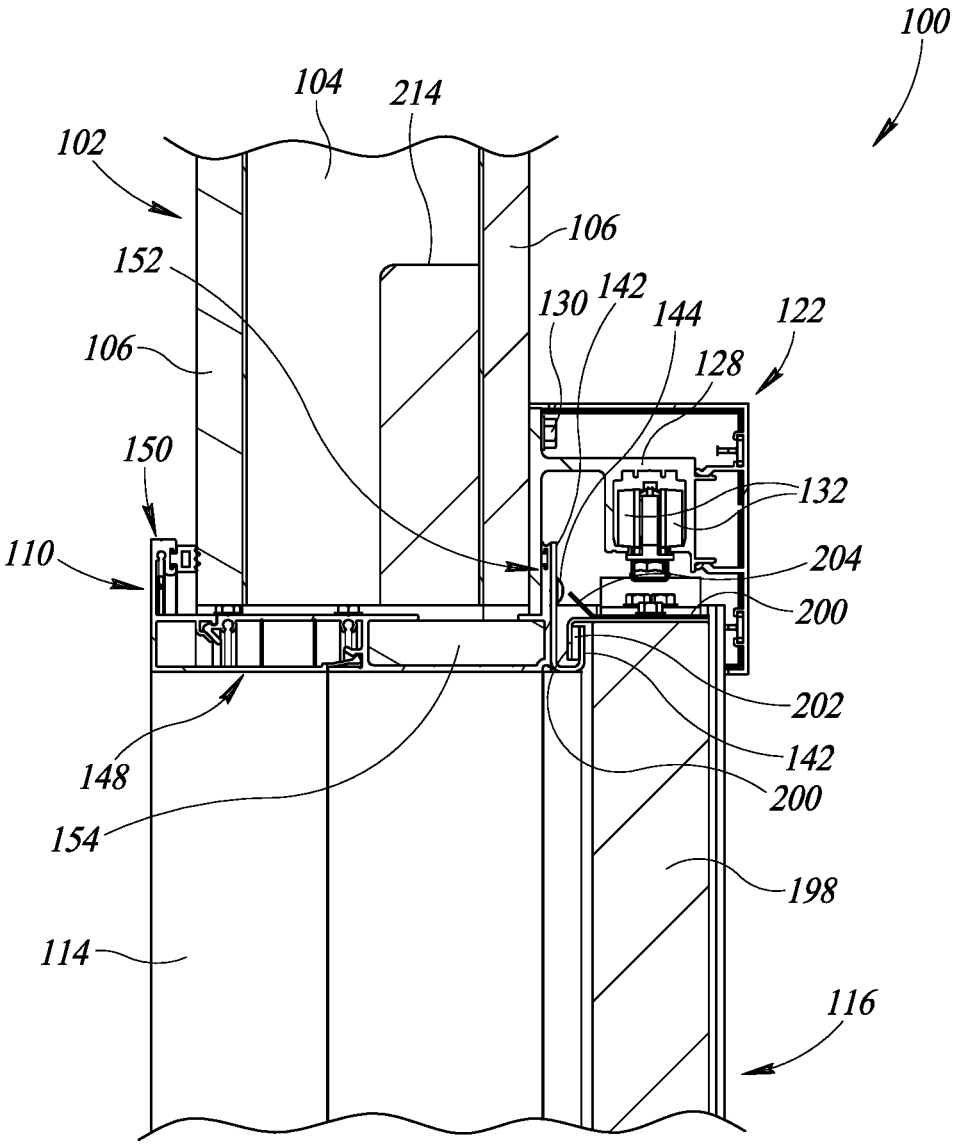
FIG. 26 illustrates a cross-sectional view of the components illustrated in FIG. 1, taken along a line corresponding to line 7-7 in FIG. 6, in accordance with one or more implementations of the technologies described herein.

FIG. 26 illustrates a cross-sectional view of the components illustrated in FIG. 1, with the door panel 116 in its closed position, taken along a line corresponding to line 7-7 in FIG. 6. FIG. 26 illustrates the interaction and interlocking of various components described above. For example, FIG. 26 illustrates that the bolts 130 and the bolts 144 extend into the wall 102 and into a horizontal stud 214 located therein. As another example, FIG. 26 also illustrates the interaction and the interlocking of the top end door seal 200 with the rail 142, with the first strip of intumescent tape 202 positioned therebetween.

Figure 27:
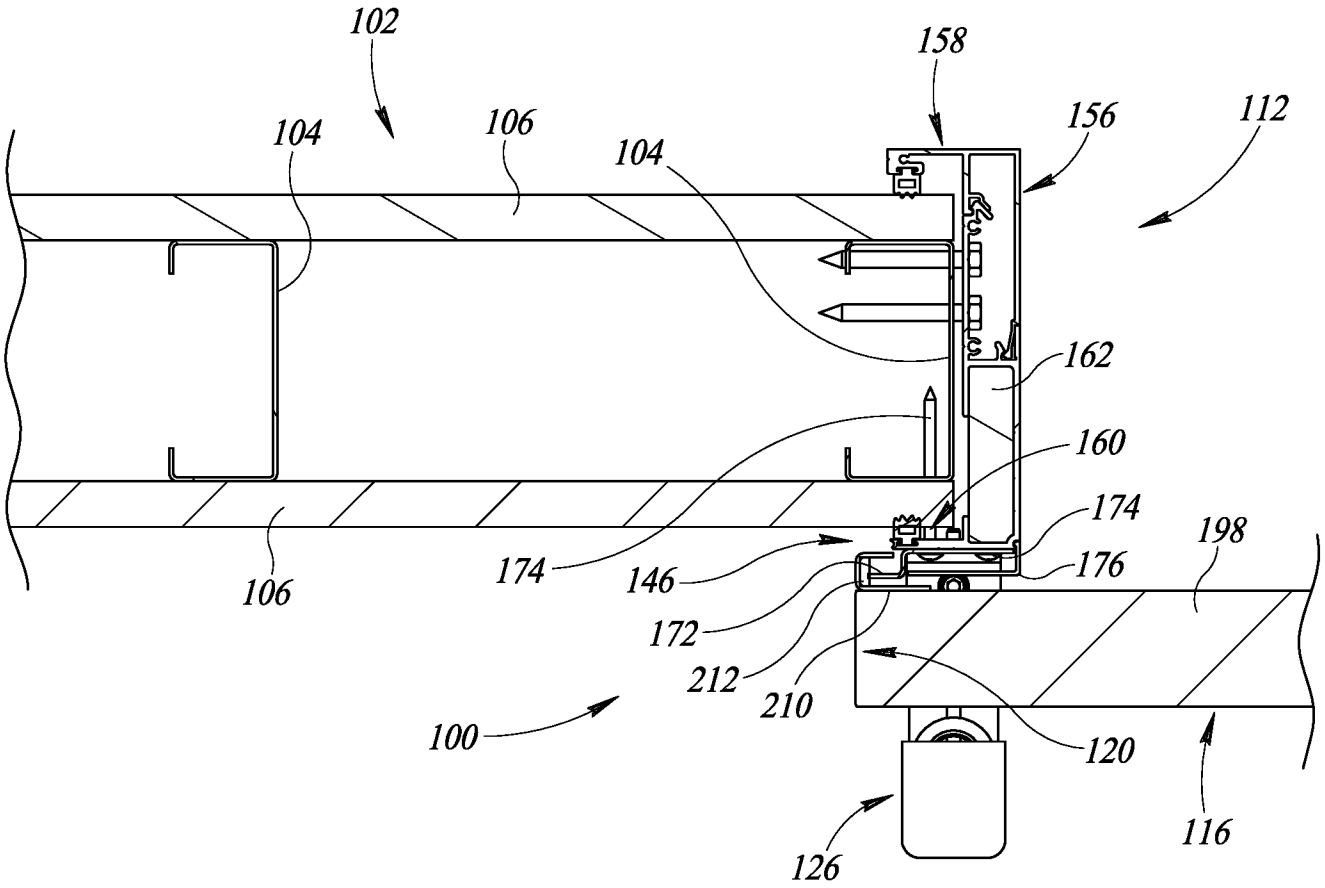
FIG. 27 illustrates a cross-sectional view of the components illustrated in FIG. 1, taken along a line corresponding to line 8-8 in FIG. 6, in accordance with one or more implementations of the technologies described herein.

FIG. 27 illustrates a cross-sectional view of the components illustrated in FIG. 1, with the door panel 116 in its closed position, taken along a line corresponding to line 8-8 in FIG. 6. FIG. 27 illustrates the interaction and interlocking of various components described above. For example, FIG. 27 illustrates that the bolts 174 extend into the wall 102 and into a vertical stud 104 located therein. As another example, FIG. 27 also illustrates the interaction and the interlocking of the trailing end door seal 210 with the trailing edge column 146, with the third strip of intumescent tape 212 positioned therebetween.

Figure 28:
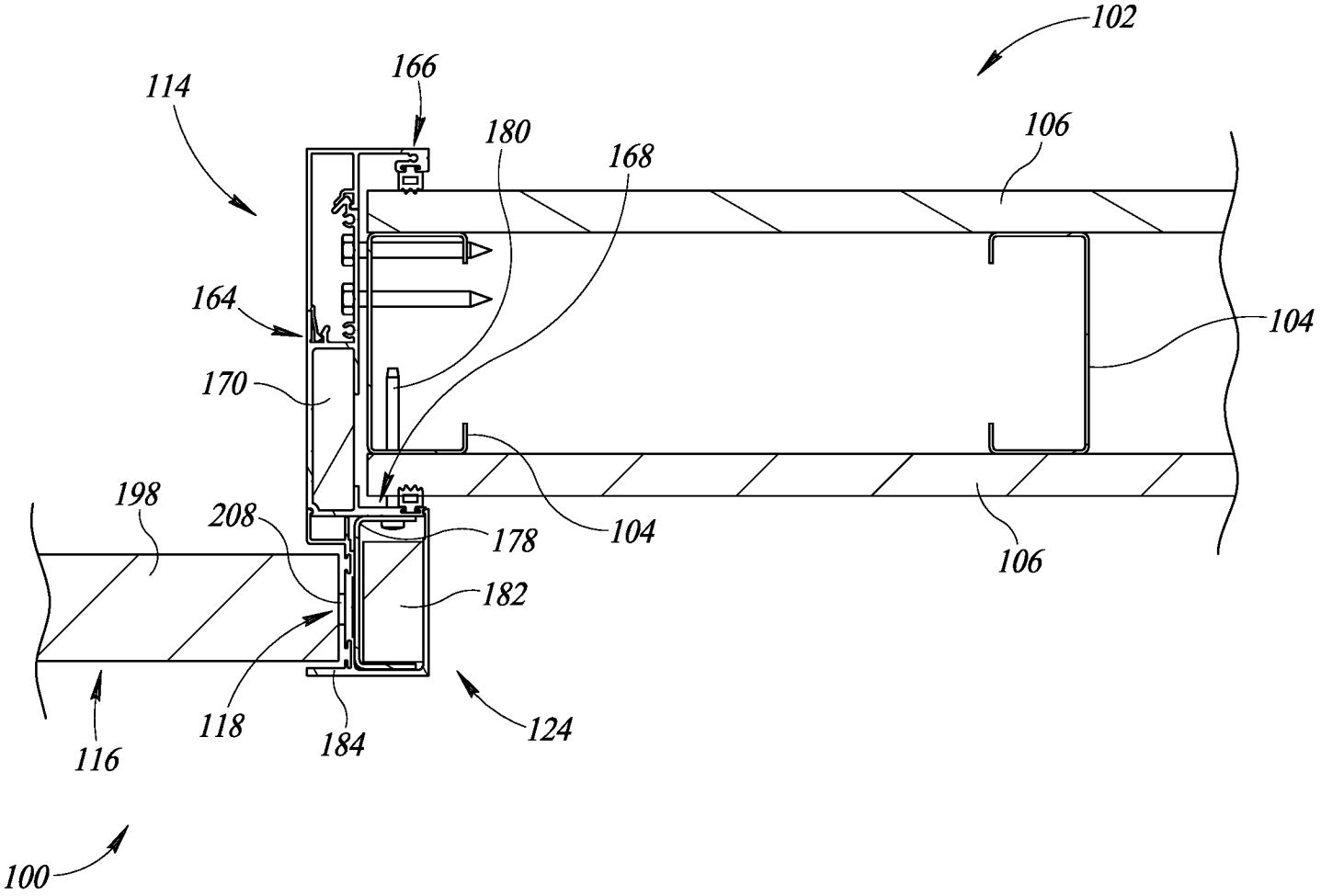
FIG. 28 illustrates a cross-sectional view of the components illustrated in FIG. 1, taken along a line corresponding to line 9-9 in FIG. 6, in accordance with one or more implementations of the technologies described herein.

FIG. 28 illustrates a cross-sectional view of the components illustrated in FIG. 1, with the door panel 116 in its closed position, taken along a line corresponding to line 9-9 in FIG. 6. FIG. 28 illustrates the interaction and interlocking of various components described above. For example, FIG. 28 illustrates that the bolts 180 extend into the wall 102 and into a vertical stud 104 located therein. As another example, FIG. 28 also illustrates the interaction and the interlocking of the leading edge 118 of the door panel 116 with the leading edge column 124, with the second strip of intumescent tape 208 positioned therebetween.

As illustrated in FIG. 26, a gap exists between the underside of the first flange 200*a* of the top end door seal 200 and a top end of the second vertical flange 142*c* of the rail 142, as well as between a bottom end of the second flange 200*b* of the top end door seal 200 and an upper surface of the web 142*b* of the rail 142. Thus, during ordinary operation, the top end door seal 200 does not directly contact the rail 142. The smaller of these two gaps can have the same dimension as the air gap between the bottom of the door panel 116 and a floor surface below the bottom of the door panel 116 discussed above. These gaps can also have the same dimension as a gap between a latch, deadbolt, or other locking element of the door panel 116 and a corresponding and/or mating feature of a strike plate or other component coupled to the aperture 188 of the leading edge door seal 184.

In some implementations, the sliding door system 100 can be installed at an opening in the wall 102 such that the front of the system 100 faces a route of egress within a building, such that in the case of a fire, the door panel 116 can be closed to protect the route of egress from the fire. In other implementations, the sliding door system 100 can be installed at an opening in the wall 102 such that the rear of the system 100 faces a route of egress within a building, such that in the case of a fire, the door panel 116 can be closed to protect the route of egress from the fire. In either case, in the event of a fire, the heat generated can melt or otherwise destroy the components of the hanging and/or rolling systems described herein, which may be made of plastic materials.

In such an event, if the door panel 116 begins to sag or fall due to the failure of the hanging components, the door panel 116 will be caught by the interaction, engagement, and interlock between the top end door seal 200 and the rail 142, by the interaction of the latch, deadbolt, or other locking components with the corresponding strike plate or other similar components, and by the interaction between the bottom end of the door panel 116 and the floor surface. As this occurs, the first, second, and third strips of intumescent material, such as intumescent tape, 202, 208, and 212 expand and create a seal between the door panel 116 and the wall 102 that prevents the passage of smoke and gasses from one side of the wall 102 to the other, opposite side of the wall. If the melted or otherwise failed components begin to drip downward under the force of gravity, the top end door guard 204 catches any dripping or falling materials and guides them away from the seal between the door panel 116 and the wall 102, thereby protecting the seal therebetween.

Any of the components described herein can be made of any suitable materials, such as metallic materials including aluminum, steel, or stainless steel. In some implementations, the door frame 108 is made of aluminum while various components of the sliding door system 100, including the rail 142, the leading edge column 124, and the trailing edge column 146, as well as various components of the door panel 116, are made of steel or stainless steel. The sliding door system 100 is modular and can be mounted over any type of door frame (e.g., it can be retrofit over existing or old door frames) and can incorporate any type of sliding door hanging and/or rolling components (e.g., so that the hanging and/or rolling components can be selected independently of the remaining components to be heavy duty or light duty, manually controlled or automated, motorized, and/or electronically controlled).

In some implementations, the sliding door system 100 can be self-closing and/or self-latching, such as to meet certain building code requirements. For example, the sliding door system 100 can include a spring system and a latch system at its header 122 to control movement of the door panel 116. In some implementations, the sliding door system 100 can also include a detent hold-open, to hold the door panel 116 in an open position against the force of the spring system. In some implementations, the sliding door system 100 also includes an electrical fire control system that is configured to automatically move the door panel 116 into its closed position in the event of a fire. In some implementations, the sliding door system 100 also includes an electric strike latch mechanism, such as to meet certain building code requirements.

The first, second, and third strips of intumescent material, such as intumescent tape, 202, 208, and 212 are described herein as components of the door panel 116 and as being coupled to the door leaf 198. In alternative implementations, however, one, two, or all three of the first, second, and third strips of intumescent tape may not be components of the door panel 116 and may instead be coupled to other components of the sliding door system 100. As one example, the first strip of intumescent tape 202 can be coupled to a rear surface of the second flange 142*c* of the rail 142 rather than to the top end door seal 200. As another example, the second strip of intumescent tape 208 can be coupled to the inward-facing surface of the second flange 184*c* of the leading edge door seal 184 rather than to the leading end of the door leaf 198. As another example, the third strip of intumescent tape 212 can be coupled to a trailing end of the second flange 172*c* of the trailing edge door seal 172 rather than to the trailing end door seal 210.

In one alternative implementation, the sliding door system 100 does not include various mechanical components described herein that provide interlocking and engaging functionality. In such an alternative implementation, the door leaf 198 may have a leading end formed of a large reservoir of intumescent material, such as a thick intumescent tape that extends from proximate the bottom end of the leading end of the door leaf 198 to proximate the top end of the leading end of the door leaf 198. In such an alternative implementation, the door leaf 198 may also have a trailing end formed of a large reservoir of intumescent material, such as a thick intumescent tape that extends from proximate the bottom end of the trailing end of the door leaf 198 to proximate the top end of the trailing end of the door leaf 198. In such an alternative implementation, the door leaf 198 may also have a top end formed of a large reservoir of intumescent material, such as a thick intumescent tape that extends from proximate the left end of the top end of the door leaf 198 to proximate the right end of the top end of the door leaf 198. In one variation on this alternative implementation, the reservoirs of the intumescent material may be located at and coupled to the door frame 108 rather than the door leaf 198.

In some implementations, more than one of the sliding door system 100 can be combined to provide larger sliding doors systems. In some cases, two of the sliding door system 100 can be positioned adjacent to one another, where a left-most one of the sliding door systems 100 is left-handed and a right-most one of the sliding door systems 100 is right-handed, such that leading ends of the two door panels 116 face one another and the two door panels 116 can be opened to provide a larger, wider opening in the wall 102. In other cases, two or more of the sliding door system 100 can be combined to provide a telescoping sliding door system. In such cases, both of the sliding door systems 100 may be left-handed or both of the sliding door systems 100 may be right-handed.

In some implementations, the door panel 116 and/or its door leaf 198 can provide a break-away door. In such implementations, a main body of the door panel 116 and/or of the door leaf 198 forms a sliding primary door, and also forms a frame or a foundation from which a smaller door may break-away, such as to swing outward from the main body to provide a hinged secondary door.

The various implementations described above can be combined to provide further implementations. These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A system, comprising:

a first rail coupleable to a wall at a first location above an opening in the wall, the opening extending between a front surface of the wall and a rear surface of the wall;

a second rail coupleable to the wall at a second location above the opening;

a door panel including:

a plurality of wheels engaged with the first rail; and a top end door seal configured to interlock with the second rail to create a seal between the door panel and the wall upon failure of the engagement of the wheels with the first rail.

2. The system of claim 1, further comprising:

a door frame including a header mounted to the wall at a top end of the opening, a leading jamb mounted to the wall at a leading end of the opening, and a trailing jamb mounted to the wall at a trailing end of the opening, wherein the second rail is coupled to the header.

3. The system of claim 2 wherein the wall includes a plurality of studs and the second rail is coupled to the header by a mechanical fastener that extends through the second rail, through the header, and into one of the studs.

4. The system of claim 3 wherein the mechanical fastener extends through the second rail, through the header, through the first rail, and into the one of the studs.

5. The system of claim 4 wherein the first rail is coupled to the wall by a second mechanical fastener that extends through the first rail and into one of the studs, and that does not extend through the second rail or through the header.

6. The system of claim 5, further comprising a strip of intumescent material located between the second rail and the top end door seal.

7. The system of claim 2 wherein the door frame comprises aluminum, the first rail is made of stainless steel, and the second rail is made of stainless steel.

8. The system of claim 2 wherein the second rail has a first flange that lies against the header, a web that extends away from a bottom end of the first flange, and a second flange that extends away from a front end of the web.

9. The system of claim 8 wherein the door panel includes a door leaf having an upper surface, and the top end door seal includes a first flange that lies against the upper surface of the door leaf and a second flange that extends downward from a rear end of the first flange.

10. The system of claim 9 wherein the top end door seal creates a gap between the second flange of the top end door seal and a rear surface of the door leaf.

11. The system of claim 10 wherein the second flange of the top end door seal is positioned at least partially between the first flange of the second rail and the second flange of the second rail, and the second flange of the second rail is positioned at least partially between the second flange of the top end door seal and the door leaf.

12. The system of claim 11 wherein the header includes a body of a material having a high thermal capacity.

13. The system of claim 2, further comprising a leading edge column coupled to the leading jamb.

14. The system of claim 13 wherein the wall includes a plurality of studs and the leading edge column is coupled to the leading jamb by a mechanical fastener that extends through the leading edge column, through the leading jamb, and into one of the studs.

15. The system of claim 14, further comprising a strip of intumescent material located between the door panel and the leading edge column.

16. The system of claim 15 wherein the leading jamb includes a body of a material having a high thermal capacity.

17. The system of claim 15 wherein the leading edge column includes a body of a material having a high thermal capacity.

18. The system of claim 2, further comprising a trailing edge column coupled to the trailing jamb.

19. The system of claim 18 wherein the wall includes a plurality of studs and the trailing edge column is coupled to the trailing jamb by a mechanical fastener that extends through the trailing edge column, through the trailing jamb, and into one of the studs.

20. The system of claim 19, further comprising a strip of intumescent material located between a component of the door panel and the trailing edge column.

21. The system of claim 20 wherein the trailing jamb includes a body of a material having a high thermal capacity.

* * * * *